US012092346B2

(12) United States Patent
Fuse et al.

(10) Patent No.: US 12,092,346 B2
(45) Date of Patent: Sep. 17, 2024

(54) CEILING-EMBEDDED AIR CONDITIONER

(71) Applicant: FUJITSU GENERAL LIMITED, Kanagawa (JP)

(72) Inventors: Takuto Fuse, Kanagawa (JP); Kazuma Hosoda, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 915 days.

(21) Appl. No.: 17/042,517

(22) PCT Filed: Mar. 15, 2019

(86) PCT No.: PCT/JP2019/010753
§ 371 (c)(1),
(2) Date: Sep. 28, 2020

(87) PCT Pub. No.: WO2019/188385
PCT Pub. Date: Oct. 3, 2019

(65) Prior Publication Data

US 2021/0025602 A1 Jan. 28, 2021

(30) Foreign Application Priority Data

Mar. 30, 2018 (JP) ..... 2018-069617
Mar. 30, 2018 (JP) ..... 2018-069618
May 31, 2018 (JP) ..... 2018-104531

(51) Int. Cl.
*F24F 1/0047* (2019.01)
*F24F 1/0063* (2019.01)

(52) U.S. Cl.
CPC ..... *F24F 1/0047* (2019.02); *F24F 1/0063* (2019.02)

(58) Field of Classification Search
CPC ..... F24F 1/0063; F24F 1/0014; F24F 1/0047; F24F 13/20
See application file for complete search history.

(56) References Cited

FOREIGN PATENT DOCUMENTS

| | | | | | |
|---|---|---|---|---|---|
| CN | 1521460 | A | * | 8/2004 | ..... F24F 1/005 |
| JP | H06272884 | A | * | 9/1994 | |
| JP | 2001263703 | A | * | 9/2001 | |
| JP | 2001311531 | A | * | 11/2001 | |
| JP | 2005337571 | A | * | 12/2005 | |
| JP | 2012102891 | A | * | 5/2012 | ..... F24F 1/0007 |
| JP | 6855875 | B2 | * | 4/2021 | |
| KR | 19990042027 | A | * | 6/1999 | |

* cited by examiner

*Primary Examiner* — Devon Russell
(74) *Attorney, Agent, or Firm* — Paratus Law Group, PLLC

(57) ABSTRACT

In a mode in which a blowing fan is disposed in an air blowing chamber surrounded by heat exchangers, air sucked from an air blowing opening is directed to each heat exchanger without bias. Even in a mode in which an air blower is disposed in an air blowing chamber which is formed between a first heat exchange part and a second heat exchange part disposed to face each other, and an air suction opening is disposed on the side of a second air suction chamber outside the second heat exchange part, an air guide path is formed from the air suction part to a first air suction chamber on the side of the first heat exchange part between the rear surface of the decorative panel and the bottom surface of the drain pan, so that the air sucked from the air blowing opening is directed to the first heat exchange part and the second heat exchange part without bias.

19 Claims, 20 Drawing Sheets

(a)

(b)

(a)

(b)

CEILING-EMBEDDED AIR CONDITIONER

CROSS REFERENCE TO PRIOR APPLICATION

This application is a National Stage Patent Application of PCT International Patent Application No. PCT/JP2019/010753 (filed on Mar. 15, 2019) under 35 U.S.C. § 371, which claims priority to Japanese Patent Application Nos. 2018-069617 (filed on Mar. 30, 2018), 2018-069618 (filed on Mar. 30, 2018), and 2018-104531 (filed on May 31, 2018), which are all hereby incorporated by reference in their entirety.

TECHNICAL FIELD

The present invention relates to a ceiling-embedded air conditioner, and more particularly to the structure of an indoor unit.

BACKGROUND ART

In a ceiling-embedded air conditioner, an outdoor unit installed outdoors and an indoor unit installed in a ceiling of an air conditioning room are connected by a gas pipe and a liquid pipe to form a refrigerant circuit. The indoor unit has a box-shaped main unit that is buried in the ceiling back space, and a decorative panel that is disposed on the air conditioning room side of the ceiling and attached to the main unit.

As an example, in the invention described in Patent Literature 1, a U-shaped heat exchanger in the main unit, a fan casing in the center of the heat exchanger, and a blowing fan formed of a sirocco fan surrounded by the fan casing are provided. The decorative panel has a blowing opening at the center and suction openings along three sides below the heat exchanger.

Then, the air sucked from the suction opening can exchange heat with the refrigerant in the heat exchanger and can be blown out in one direction from the blowing opening. By surrounding the blowing fan with the heat exchanger, the distance between the blowing fan and the surface of the heat exchanger is almost constant, and there is little bias in the wind speed and air volume of the air passing through the heat exchanger. The heat exchanger is used effectively so that the heat exchange performance can be increased.

CITATION LIST

Patent Literature

PATENT LITERATURE 1: JP-A-2000-213767

SUMMARY OF INVENTION

Problems to be Solved by Invention

By the way, when the air is blown out from the blowing opening toward, for example, one of the suction openings disposed along three sides on the lower side of the heat exchanger, a so-called short circuit occurs. Therefore, it is not preferable to provide a suction opening on the air blowing direction side.

The air passage extending from the suction opening to the heat exchanger is preferably short in view of reducing ventilation resistance and designing the housing. Therefore, the heat exchanger is usually provided near the suction opening. Therefore, when disposing the heat exchanger around the blowing fan, the heat exchanger is not disposed on the air blowing direction side where it is not preferable to provide the suction opening. Improvement on this point has been desired in order to increase the heat exchange performance.

Therefore, an object of the invention is to provide a ceiling-embedded air conditioner with which, when the heat exchanger is disposed around the blowing fan, the heat exchanger can be disposed even at a place where the air suction opening cannot be provided.

Solution to Problems

In order to solve the above-mentioned problem, the invention provides a ceiling-embedded air conditioner which includes a box-shaped main unit that includes an air blower, a heat exchanger, and a drain pan and is disposed in a ceiling of an air conditioning room, and a decorative panel that is attached to a bottom surface of the main unit along a ceiling surface of the air conditioning room. The decorative panel is provided with an air suction part and an air blowing part. The heat exchanger includes at least two heat exchange parts of a front heat exchange part and a rear heat exchange part, the front heat exchange part and the rear heat exchange part are disposed in the main unit so as to face each other, an air blowing chamber is provided between the front heat exchange part and the rear heat exchange part, a first air suction chamber is provided outside the rear heat exchange part, a second air suction chamber is provided outside the front heat exchange part, and the air suction part is disposed on a side of the first air suction chamber. The air blower is housed in the air blowing chamber, a bottom surface of the air blowing chamber is closed by the drain pan, and an air guide path is formed from the air suction part to the second air suction chamber on a side of the front heat exchange part between the decorative panel and the drain pan.

According to a preferred aspect of the invention, a ventilation hole is formed in the drain pan, a plurality of ducts is provided in the decorative panel to be fitted into the ventilation hole so as to guide air blown out from the air blower to the air blowing part, the air guide path is formed between the duct and the duct, and a recess is formed in a bottom surface of the drain pan corresponding to the air guide path to expand a cross-sectional area of the air guide path.

In addition, according to an aspect of the invention, the air blowing part includes a raised portion that projects toward the air conditioning room rather than a panel surface of the decorative panel, and is formed with an air blowing opening in a side surface of the raised portion to blow out air blown out from the air blower along the panel surface of the decorative panel.

Further, the air suction part is disposed so as to be included in the panel surface of the decorative panel above the raised portion when viewed from the air conditioning room.

In the invention, it is desirable that a distance from a rotating shaft that is the center of the air blower to the front heat exchange part is L1, and a distance from the rotating shaft that is the center of the air blower to the rear heat exchange part is L2, and L1<L2 is satisfied.

In the invention, the air blower includes a fan motor, an impeller driven by the fan motor, and a fan casing surrounding the impeller, and a side of the fan casing that faces the front heat exchange part is formed in a horizontal plane.

In addition, a distance between an upper end of the front heat exchange part and an upper end of the rear heat exchange part is larger than a distance between a lower end of the front heat exchange part and a lower end of the rear heat exchange part.

Effects of Invention

According to the invention, it is possible to dispose the heat exchanger even in a place where the air suction part cannot be provided in the decorative panel.

DESCRIPTION OF EMBODIMENTS

Hereinafter, some modes for carrying out the invention will be described in detail as embodiments based on the accompanying drawings. The invention is not limited to this.

An air conditioner according to the invention is a refrigerant circuit in which an outdoor unit (not illustrated) installed outdoors and an indoor unit 1 attached to a ceiling T1 of an air conditioning room R are connected by a gas pipe and a liquid pipe (both not illustrated).

Figure 1:
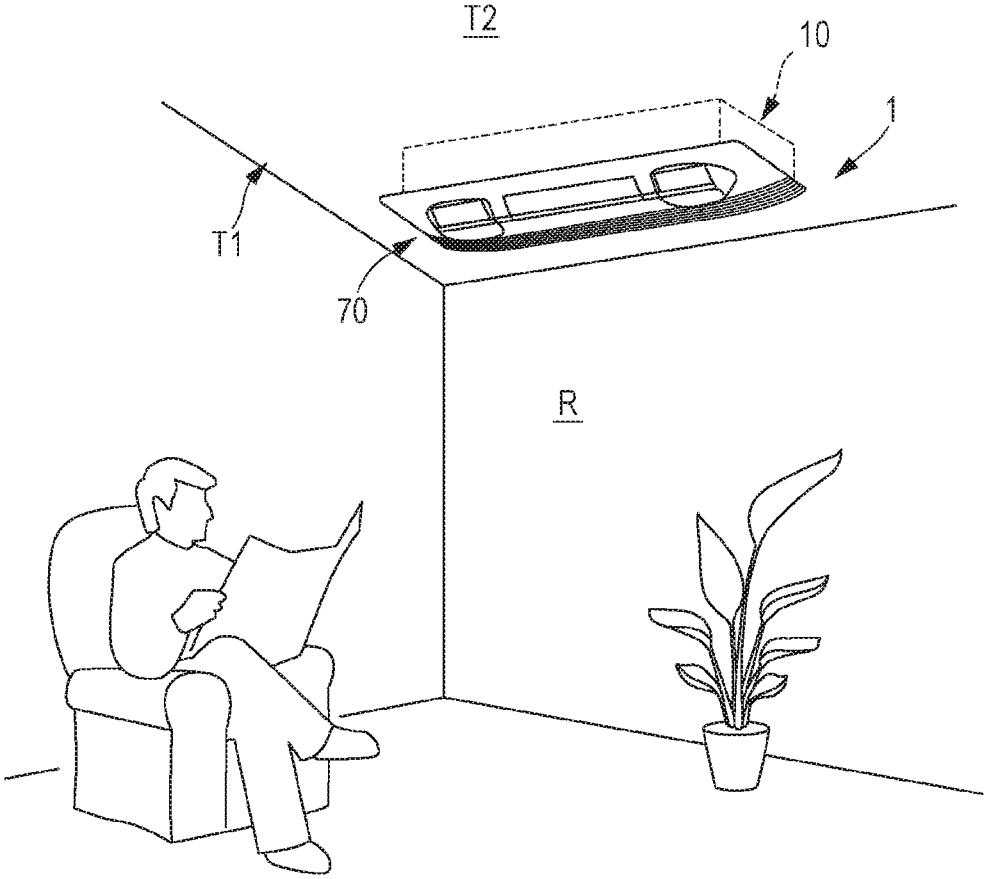
FIG. 1 is an explanatory view illustrating an installed state of a ceiling-embedded air conditioner according to the invention.
Figure 2:
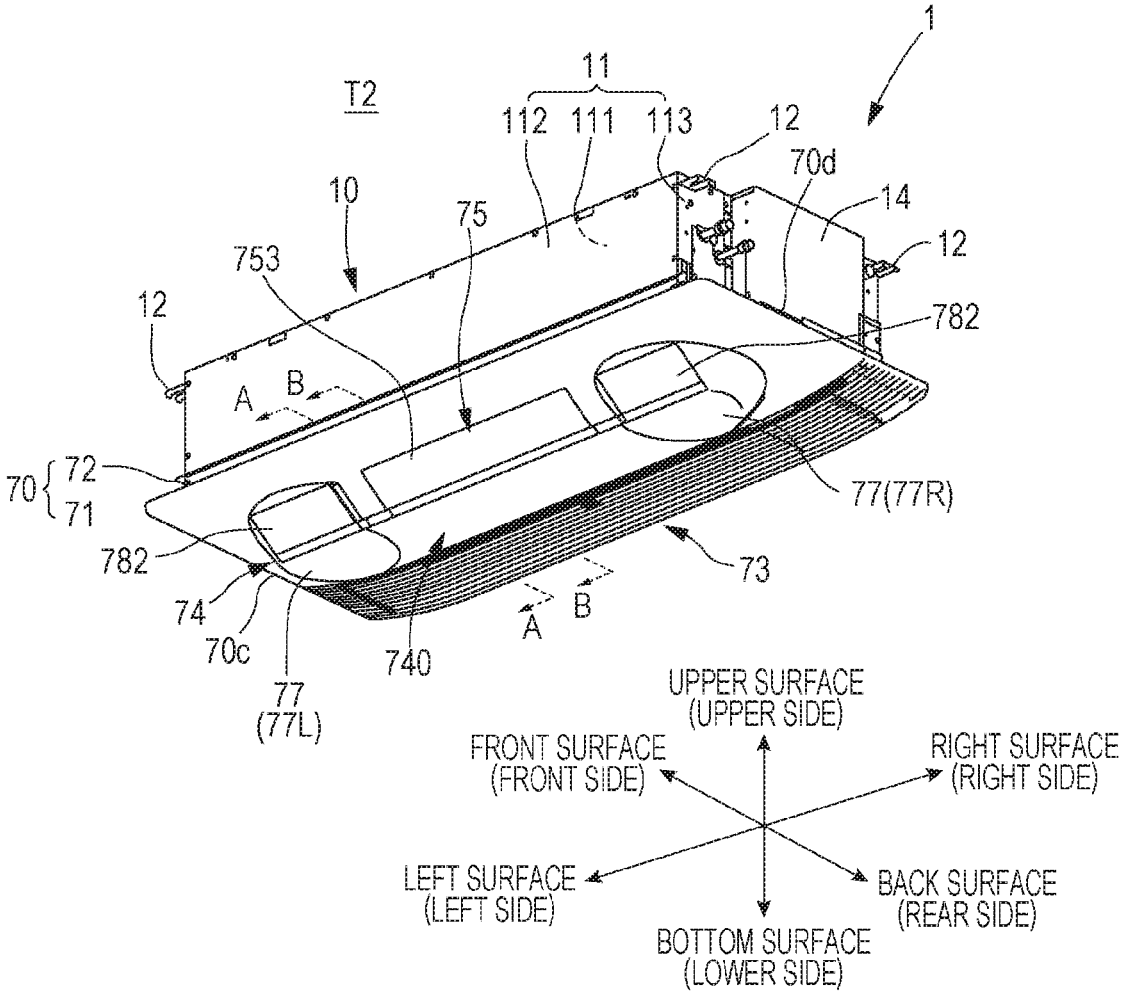
FIG. 2 is a perspective view illustrating the ceiling-embedded air conditioner.
Figure 3:
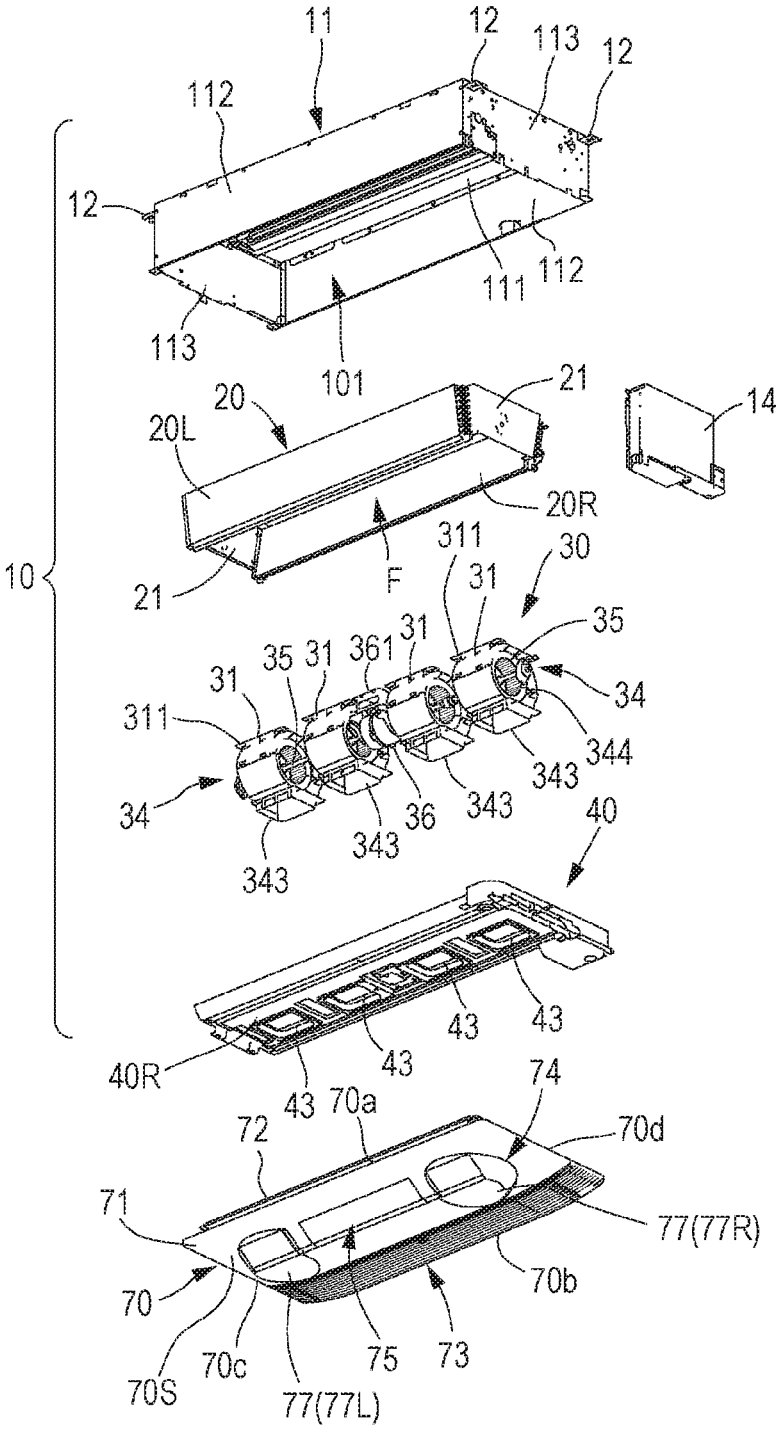
FIG. 3 is an exploded perspective view of the ceiling-embedded air conditioner.

With reference to FIGS. 1 to 3, an indoor unit 1 according to this embodiment is a ceiling-embedded air conditioner that includes a box-shaped main unit 10 embedded in a ceiling back space T2 and a decorative panel 70 that is disposed on the air conditioning room R side of the ceiling T1 and attached to a bottom surface 101 of the main unit 10, and particularly is an omnidirectional blow-out type ceiling-embedded air conditioner that blows out conditioned air over a wide range.

With reference to FIG. 3, the main unit 10 has a rectangular top plate 111 formed of sheet metal, and a box-shaped outer trunk 11 formed of side plates 112 and 113 extending downward from four sides of the top plate 111. The side plate on the long side of the top plate 111 is the side plate 112 and the side plate on the short side is the side plate 113, and two mounting brackets 12 are fixed to each of the two side plates 113 facing each other.

The main unit 10 is installed on the ceiling back space T2 by suspending the mounting bracket 12 with a plurality of hanging bolts (not illustrated) fixed to the ceiling back space T2.

The decorative panel 70 includes a panel portion 71 that forms the main body of the rectangular decorative panel 70 that is larger than the top plate 111, and a side wall 72 which is erected from the rear surface 70R of the panel portion 71 to the main unit 10 side and attached to the opened bottom surface (the bottom surface 101 of the main unit 10) of the box-shaped outer trunk 11.

The panel portion 71 includes an air suction part 73 that is opened in a square shape on one side 70*b* located on the rear side among the facing long sides, and an air blowing part 74 on another side 70*a* that exists in front of the long side facing the side 70*b*.

In the indoor unit 1 in FIG. 2, the top plate 111 direction will be described as the upper surface or the upper side, the air conditioning room R direction as the bottom surface or the lower side, the air blowing part 74 side as the front surface or the front side, and the air suction part 73 side as the back surface side or the rear side, the left short side 70*c* side as the left surface or the left side, and the right short side 70*d* side as the right surface or the right side. The same applies to each component.

Figure 10:
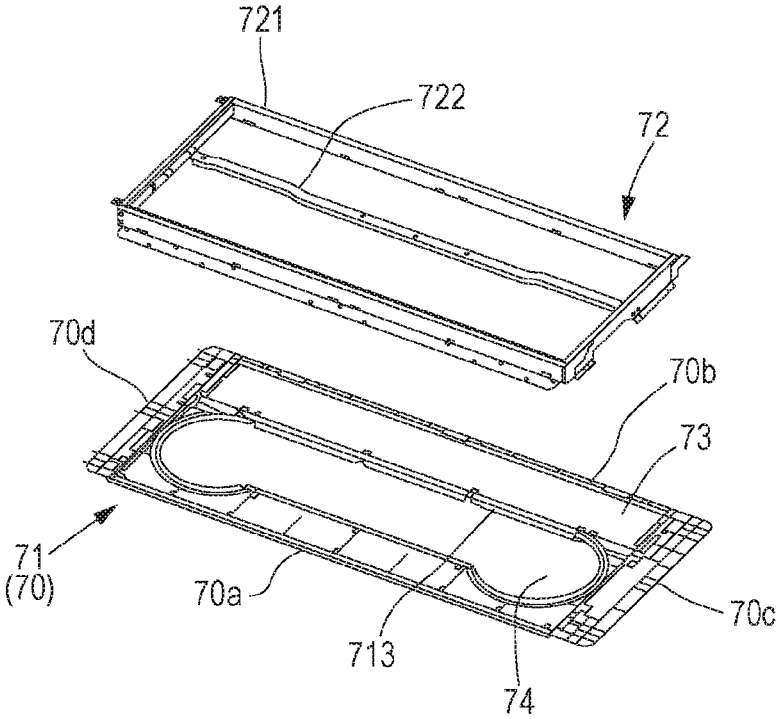
FIG. 10(*a*) is a perspective view illustrating a decorative panel and a frame separately, and FIG. 10(*b*) is a perspective view illustrating a packaging state of the decorative panel.
Figure 10:
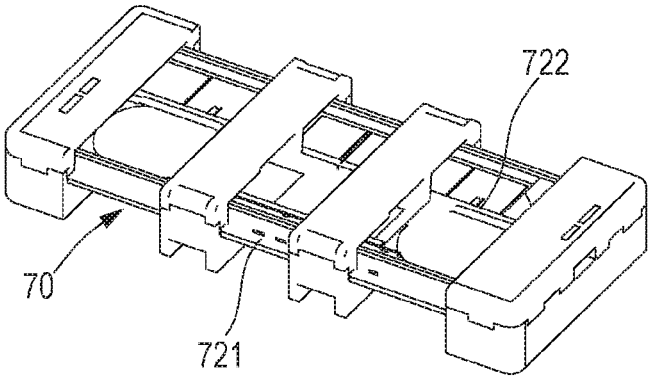

As illustrated in FIG. 10(*a*), the side wall 72 includes a frame 721 which is formed in a rectangular shape along the respective sides (the long sides 70*a* and 70*b* and the short sides 70*c* and 70*d*) of the panel portion 71 with a size surrounding the air suction part 73 and the air blowing part 74, and a beam 722 which is suspended between the short sides (sides on the short sides 70*c* and 70*d* side of the panel portion 71) of the frame 721. The side wall 72 is screwed integrally to the rear surface of the panel portion 71 (the decorative panel 70).

Both the frame 721 and the beam 722 are made of sheet metal, and the beam 722 is disposed on a partition portion 713 formed between the air suction part 73 and the air blowing part 74 of the panel portion 71.

According to this, as illustrated in FIG. 10(*b*), when the decorative panel 70 is packed, the protruding piece on the packing material presses the beam 722, so that it is possible to prevent damage due to impact such as dropping. Further, with the beam 722, the structure can withstand a load applied in a direction parallel to a panel surface 70S of the decorative panel 70.

Further, the beam 722 may be suspended between the long sides 70*a* and 70*b* of the frame 721 depending on the shapes and arrangements of the air suction part 73 and the air blowing part 74 and the like.

<<Outer Trunk>>

Next, the components housed in the main unit 10 will be described with reference to FIGS. 3 to 6. On the inner surface of the top plate 111 of the outer trunk 11, a heat insulating material 13 made of styrene foam having a large plate thickness is provided.

A thin heat insulating sheet (not illustrated) may be provided on the inner surfaces of the side plates 112 and 113 of the outer trunk 11 without providing the heat insulating material 13. The center of the heat insulating material 13 is opened, and a part of the top plate 111 is exposed when viewed from below. A heat exchanger 20 and a fan unit 30 are fixed to this exposed portion of the top plate 111.

As illustrated in FIG. 2, an electrical equipment box 14 accommodating electric components (not illustrated) for controlling the indoor unit 1 is attached to the outer surface of the right surface of the outer trunk 11.

<<Heat Exchanger>>

Figure 4:
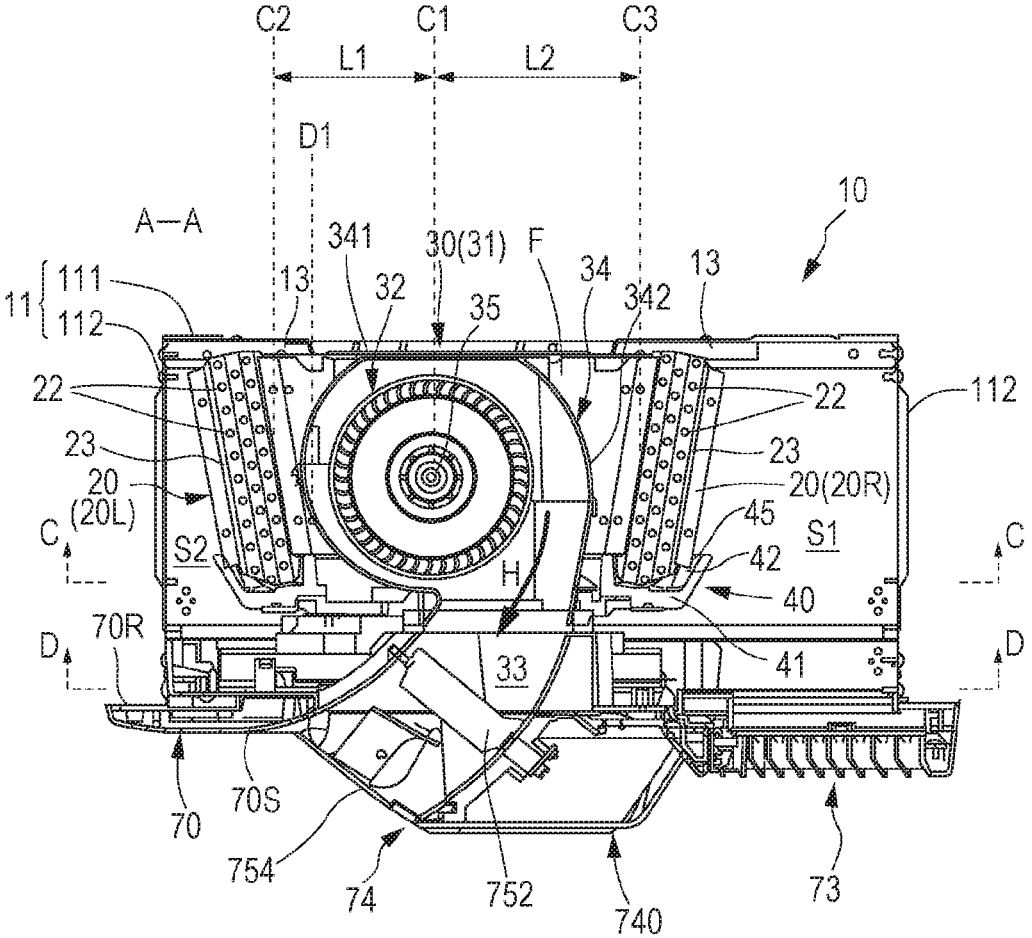
FIG. 4 is a schematic cross-sectional view taken along the line A-A of FIG. 2.
Figure 5:
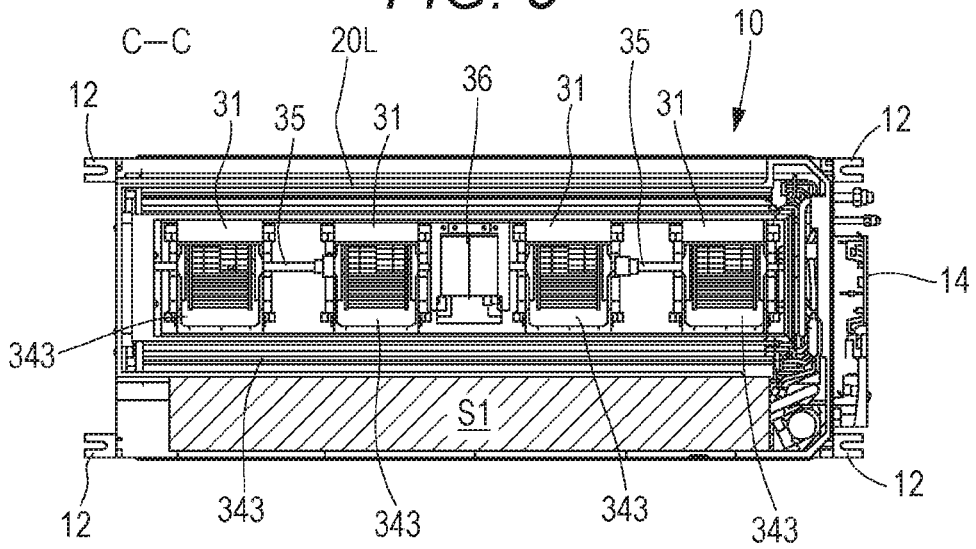
FIG. 5 is a schematic cross-sectional view taken along the line C-C of FIG. 4.

The heat exchanger 20 includes a plurality of strip-shaped aluminum fins 23 disposed in parallel, and two heat exchange parts of a front heat exchange part (first heat exchange part) 20L on the left side in FIG. 4 and a rear heat exchange part (second heat exchange part) 20R on the right side in FIG. 4 which are separated from each other and in a fin-tube shape formed by the plurality of heat transfer tubes 22 passing through the aluminum fins 23.

The front heat exchange part 20L and the rear heat exchange part 20R are attached to the top plate 111 so as to face each other. The front heat exchange part 20L and the rear heat exchange part 20R may be disposed substantially perpendicular to the top plate 111 and parallel to each other, but are preferably combined in a V shape such that the gap (distance) on the upper end side becomes wider (longer) than the gap (distance) on the lower end side as illustrated in FIG. 4 in order to suppress the height dimension to be low and to increase a heat exchange area. Instead of the V shape, these parts may be disposed in an inverted V shape in which the gap (distance) on the upper end side is narrower (shorter) than the gap (distance) on the lower end side.

In any case, the left and right ends of the front heat exchange part 20L and the rear heat exchange part 20R are connected by connecting plates 21 and 21, respectively. As a result, the space inside the heat exchanger 20 becomes an air blowing chamber F in which both left and right ends are closed by the connecting plates 21 and 21. The bottom surface of the heat exchanger 20 (the surface between the lower ends of the front heat exchange part 20L and the rear heat exchange part 20R) is closed by a drain pan 40 described later.

Thus, since the left and right ends of the front heat exchange part 20L and the rear heat exchange part 20R are closed by the connecting plates 21 and 21, all the air sucked from the air suction part 73 passes through the front heat exchange part 20L and the rear heat exchange part 20R. Therefore, the heat exchange performance is further increased without causing an unnecessary air flow.

Further, in the gap between the heat exchanger 20 and the outer trunk 11, a first air suction chamber S1 is provided between the outer trunk 11 and the rear heat exchange part 20R, and a second air suction chamber S2 is provided between the outer trunk 11 and the front heat exchange part 20L. The first air suction chamber S1 is disposed directly above the air suction part 73, and the second air suction chamber S2 communicates with the air suction part 73 via an air guide path L described later.

<<Blowing Fan>>

The fan unit 30 is disposed in the air blowing chamber F provided inside the heat exchanger 20. The fan unit 30 includes a sirocco fan type blowing fan 31, a fan motor 36, a fan mounting base 311 (see FIG. 3) for supporting the blowing fan 31 and fixing it to the top plate 111, and a motor mounting base 361 (see FIG. 3) for fixing the fan motor 36 to the top plate 111.

The blowing fan 31 includes a cylindrical impeller (sirocco fan) 32 having a plurality of blades, a spiral fan casing 34 that contains the impeller 32, and a rotating shaft 35 that is connected to the center of the impeller 32.

The number of the blowing fans 31 is arbitrarily selected according to the required air conditioning capacity, but in this embodiment, four fans are coaxially disposed side by side. The blowing fans 31 have the same structure.

In the fan unit 30, after the fan motor 36 is fixed to the top plate 111 by the motor mounting base 361, two blowing fans 31 are connected to each other at both ends of the fan motor 36 by the rotating shafts 35. Both ends of the rotating shaft 35 are fixed to the top plate 111 via bearing plates (not illustrated) made of, for example, L-shaped metal fittings. Further, there is a fan fixing part 341 (see FIG. 4) also on the upper part of the fan casing 34, and this is fixed to the top plate 111 with a screw.

The fan casing 34 includes an accommodating part 342 that contains the impeller 32, and a cylindrical blower 343 that is formed continuously from the accommodating part 342 and extends downward below the lower end of the heat exchanger 20. A fan suction opening 344 that takes in air into the impeller 32 is opened in a circular shape on the side surface of the accommodating part 342.

The fan casing 34 may be divided into upper and lower parts in a plane parallel to the axial line of the impeller 32 so that the impeller 32 can be contained therein, or may be divided into left and right parts in a plane perpendicular to the axial line of the impeller 32. In the inside of the fan casing 34, the accommodating part 342 and the blower 343 continuously form a blowing path 33 for the blowing air H.

As described above, in this embodiment, since the fan unit 30 is disposed with the internal space surrounded by the heat exchanger 20 as the air blowing chamber F, when the impeller 32 of the blowing fan 31 rotates, the inside of the air blowing chamber F becomes negative pressure, and the air from the air suction part 73 passes through the front heat exchange part 20L and the rear heat exchange part 20R into the air blowing chamber F, and is sucked into the fan suction opening 344 to be discharged to the surroundings of the impeller 32. The discharged air is blown in one direction along the blowing path 33 in the fan casing 34, and blown from the air blowing part 74 to the air conditioning room R.

With reference to FIG. 4, in this embodiment, the distance between a center C1 of the rotating shaft 35 of the fan motor 36 and a center C2 in the vertical direction of the front heat exchange part 20L is L1, and the distance between the center C1 and a center C3 in the vertical direction of the rear heat exchange part 20R is L2, and L1<L2 is set.

According to this, since the front heat exchange part 20L is disposed close to the fan unit 30, the air intake amount of the front heat exchange part 20L near the fan unit 30 increases. Therefore, the amount of air sucked into the front heat exchange part 20L is larger than the amount of air sucked into the rear heat exchange part 20R as compared with the case of L1=L2. Therefore, even in the front heat exchange part 20L having a long air flow passage compared to the rear heat exchange part 20R, the heat exchange efficiency is the same as that in the rear heat exchange part 20R, and the balance is improved.

When L2 is the same as the conventional one, the position of the front heat exchange part 20L is close to the rear heat exchange part 20R, and accordingly, the position of the side plate 111 on the front long side of the outer trunk 11 can be brought close to the side plate 111 on the rear long side. Therefore, the front-rear dimension of the outer trunk 11 can be reduced.

When the front heat exchange part 20L side of the fan casing 34 of the fan unit 30 abuts on the front heat exchange part 20L, the side facing the front heat exchange part 20L of the fan casing 34 may be formed in a horizontal plane shape taken along line D1 illustrated in FIG. 4.

<<Drain Pan>>

The drain pan 40 that receives drain water generated in the heat exchanger 20 is provided at the lower end of the heat exchanger 20. The drain pan 40 is integrally formed with a heat insulating member 41 made of styrene foam and a drain sheet 42 made of resin provided on the surface facing the heat exchanger 20.

The drain pan 40 is formed in a rectangular shape having a size that covers the opening surface on the lower end side of the heat exchanger 20, and is also a partition plate that separates the air blowing chamber F from the air guide path L described later. The drain pan 40 is provided with ventilation holes 43 into which the cylindrical blower 343 of the fan unit 30 is fitted, as many as the blowing fans 31 (4 holes in this embodiment).

As described above, the heat exchanger 20 has the front heat exchange part 20L and the rear heat exchange part 20R disposed in a V shape, and the bottom surface is narrower than the upper surface, so that the drain pan 40 becomes smaller by that amount. The area occupied by the drain pan 40 in the main unit 10 becomes small, the ventilation resistance due to the drain pan 40 also decreases, and the ventilation area around the drain pan 40 expands to improve ventilation efficiency.

On the drain sheet 42 side of the drain pan 40, a gutter 45 is provided to receive the drain water generated in the heat exchanger 20. Further, since the dew condensation water generated on the outer surface side of the fan casing 34 during the cooling operation is received by the drain pan 40, it is preferable to perform waterproof treatment around the ventilation holes 43.

Although not illustrated, the drain pan 40 may be provided with a drain pump or a drain hose for draining drain water, a float switch for controlling on/off of the drain pump, and the like.

<<Decorative Panel>>

The configuration of the decorative panel 70 will be described with reference to FIGS. 11 to 13. The decorative panel 70 includes the air blowing part 74 on a side of the long side 70*a* and the air suction part 73 on a side of the other long side 70*b*. In the air blowing part 74, a part of the panel portion 71 is formed as a raised portion 740 that is raised in a trapezoidal cross-section shape toward the air conditioning room R along the long side 70*a*.

According to this embodiment, the raised portion 740 has an elliptical shape that is a rounded rectangular shape made up of two parallel lines of equal length and two semicircles, and has the side surface (circumferential surface) having an inclined surface. The air blowing part 74 has a fixed air blowing portion 75 in the central portion of the raised portion 740, and movable air blowing portions 77L and 77R on both left and right sides. When it is not necessary to distinguish the movable air blowing portions 77L and 77R, they are collectively referred to as the movable air blowing portion 77.

Figure 16:
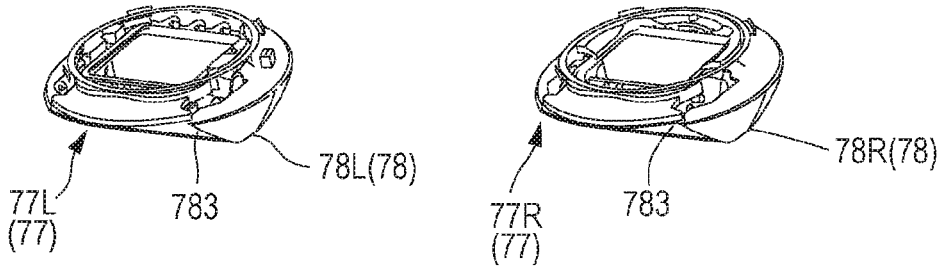
FIG. 16 is a perspective view illustrating a rotation unit attached to the partition plate unit.

Referring also to FIG. 16, the movable air blowing portion 77L includes a truncated cone-shaped rotation unit 78L which rotates within a predetermined angle range around an axial line orthogonal to a virtual plane on the rear surface 70R side of the decorative panel 70 parallel to the bottom surface 101 of the main unit 10. Similarly, the movable air blowing portion 77R also includes a truncated cone-shaped rotation unit 78R which rotates within a predetermined angle range around an axial line orthogonal to a virtual plane on the rear surface 70R side of the decorative panel 70 parallel to the bottom surface 101 of the main unit 10. The virtual plane on the rear surface 70R side of the decorative panel 70 is also parallel to the ceiling surface T1 of the air conditioning room R.

Semi-circular portions are formed at both ends of the raised portion 740 by a part of the rotation units 78L and 78R. When it is not necessary to distinguish between the rotation units 78L and 78R, they are collectively referred to as the rotation unit 78.

Figure 13:
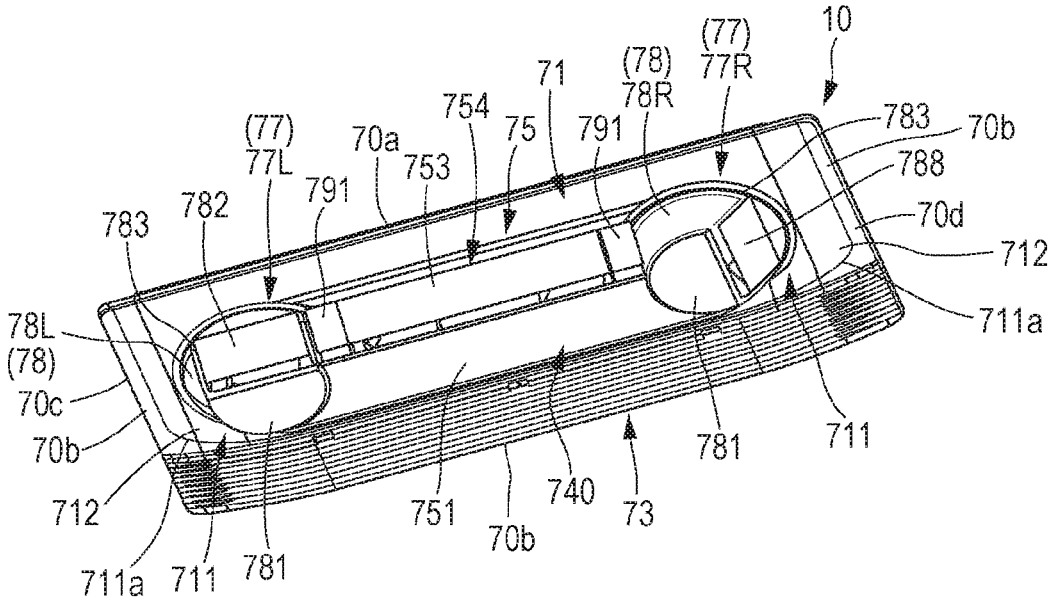
FIG. 13 is a perspective view of FIG. 12.

As can be seen from the perspective view of FIG. 13, the top surface (bottom surface) 751 of the fixed air blowing portion 75 and the top surface (bottom surface) 781 of the rotation unit 78 are always on the same plane even when the rotation unit 78 is rotated. Therefore, the design is improved.

The fixed air blowing portion 75 has a trapezoidal cross section, and a first air blowing opening 754 is opened toward the long side 70*a* of the side surface on the front long side (specific side) 70*a* side. A left/right airflow direction vane 752 (see FIG. 15) is provided inside the first air blowing opening 754, and an up/down airflow direction vane 753 is provided on the opening surface of the first air blowing opening 754.

The movable air blowing portion 77 has a second air blowing opening 783 in a part of the side surface of the rotation unit 78, and the second air blowing opening 783 is provided with an up/down airflow direction vane 782. Since the left and right airflow directions can be changed by the rotation of the rotation unit 78, the movable air blowing portion 77 does not need a left/right airflow direction vane. The first air blowing opening 754 of the fixed air blowing portion 75 and the second air blowing opening 783 of the movable air blowing portion 77 are opened along side surfaces having the same inclination angle in order to give these air blowing openings 754 and 783 a unified design.

While the air blowing direction of the fixed air blowing portion 75 is the direction of the long side 70*a*, the movable air blowing portion 77 rotates between a first position where the second air blowing opening 783 faces the long side 70*a* and a second position facing the short sides 70*c* and 70*d*, and blows out conditioned air, which is sent from the blowing fan 31 within the rotation range, in a predetermined direction.

Figure 11:
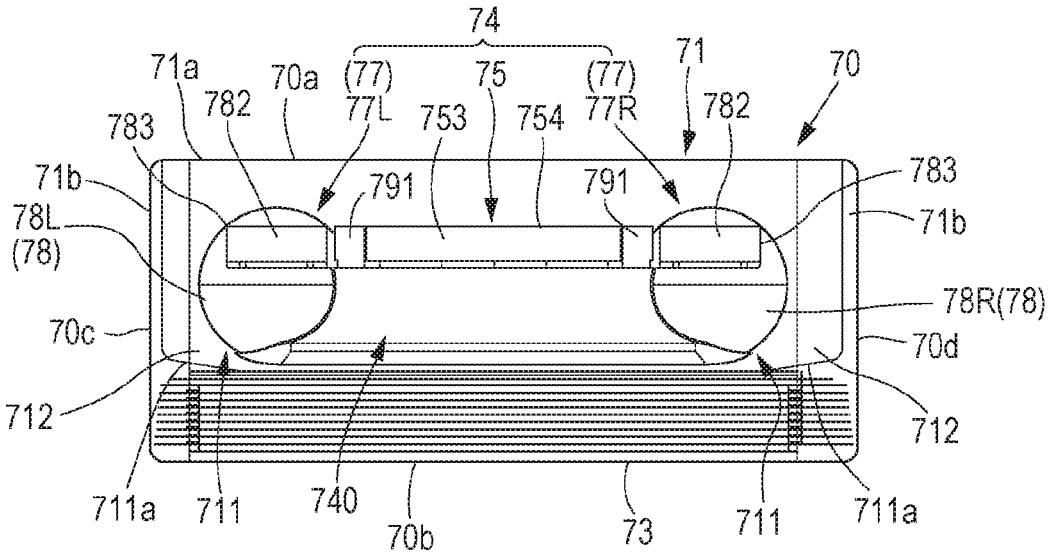
FIG. 11 is a bottom view of the decorative panel when the operation is stopped, as seen from the air conditioning room side.

As illustrated in FIG. 11, when the movable air blowing portion 77 is at the first position, the first air blowing opening 754 and the second air blowing opening 783 are disposed linearly. In this case, it is preferable to provide dummy flaps 791 and 791 on both sides of the first air blowing opening 754 in order to make the appearance such that the first air blowing opening 754 and the second air blowing opening 783 are continuous. This dummy flap 791 is also disposed on the same inclined surface as the first air blowing opening 754 and the second air blowing opening 783.

Figure 12:
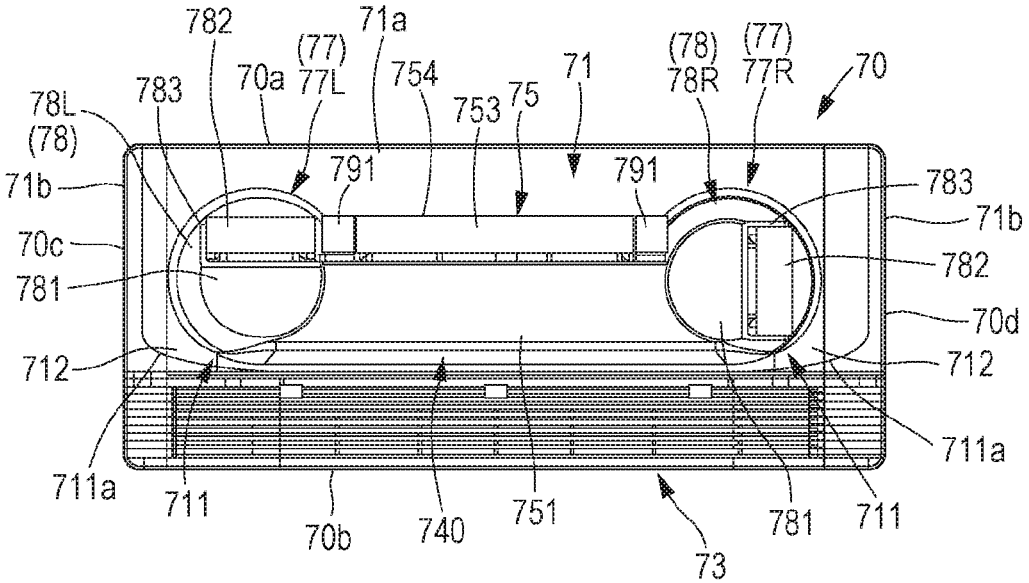
FIG. 12 is a bottom view of the decorative panel during operation as seen from the air conditioning room side.

FIGS. 12 and 13 illustrate a state in which the left movable air blowing portion 77L is at the first position and the right movable air blowing portion 77R is at the second position facing the short side 70*d*. In this way, since the movable air blowing portion 77 is rotatable, the indoor unit 1 is an omnidirectional (multidirectional) blowout type capable of blowing out conditioned air in all directions except the direction of the rear long side 70*b*.

Further, as illustrated in FIGS. 12 and 13, even if the second air blowing opening 783 of the movable air blowing portion 77 (77L) is rotated to the second position facing the short side, a feeling of continuity with the first air blowing opening 754 can be obtained in appearance since the portion other than the second air blowing opening 783 is the conical side surface. That is, even if the movable air blowing portion 77 is rotated, the basic shape of the air blowing part 74 (the elliptical raised shape) is maintained.

According to this embodiment, the first air blowing opening 754 of the fixed air blowing portion 75 and the second air blowing opening 783 of the movable air blowing portion 77 are formed on the side surfaces of the raised portion 740 which is formed by projecting a part of the panel portion 71 in a trapezoidal cross-section shape toward the air conditioning room R. Therefore, the conditioned air is blown out substantially horizontally from the first air blowing opening 754 and the second air blowing opening 783 along the panel surface 70S of the decorative panel 70, so that the conditioned air can be spread farther.

Further, the conditioned air is simultaneously blown out from the first air blowing opening 754 and the second air blowing opening 783, but it is difficult to make a boundary between the air flow blown out from the first air blowing opening 754 and the air flow blown out from the second air blowing opening 783, and the air conditioning room R can be uniformly conditioned.

Unlike the above embodiment, the first air blowing opening 754 and the second air blowing opening 783 may be opened in a vertical plane orthogonal to the panel surface (or ceiling surface) of the decorative panel 70.

Further, in the above-described embodiment, the fixed air blowing portion 75 and the left and right movable air blowing portions 77 are housed in the elliptical raised portion 740. However, as long as the movable air blowing portion 77 can rotate about the axial line orthogonal to the virtual plane on the rear surface 70R side of the decorative panel 70 parallel to the bottom surface 101 of the main unit 10, the movable air blowing portions 77 may be simply disposed on both sides of the fixed air blowing portion 75 without being restricted by the appearance, and such aspects are also included in the invention.

Figure 9:
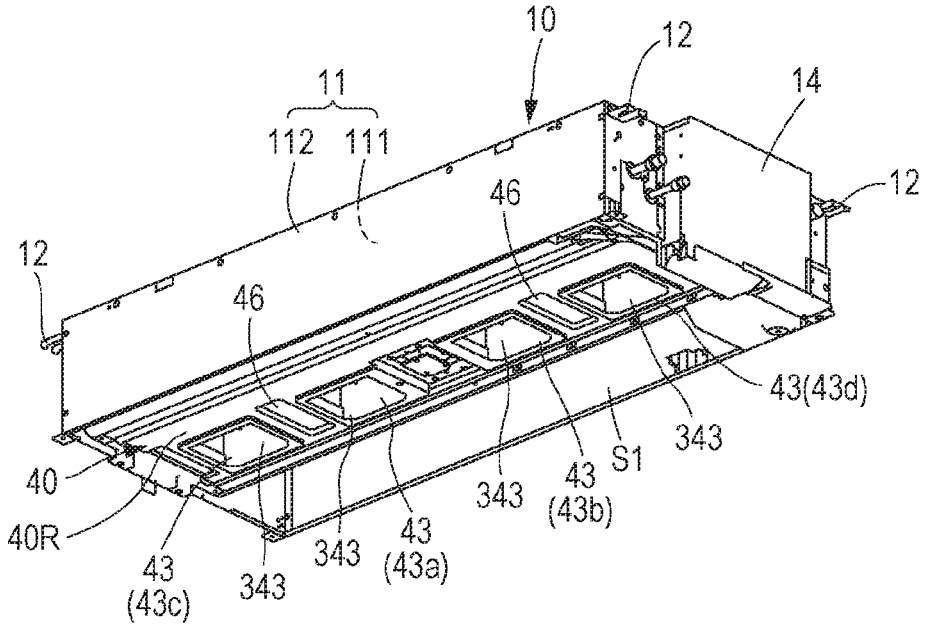
FIG. 9 is a bottom surface side perspective view of a main unit included in the ceiling-embedded air conditioner.
Figure 14:
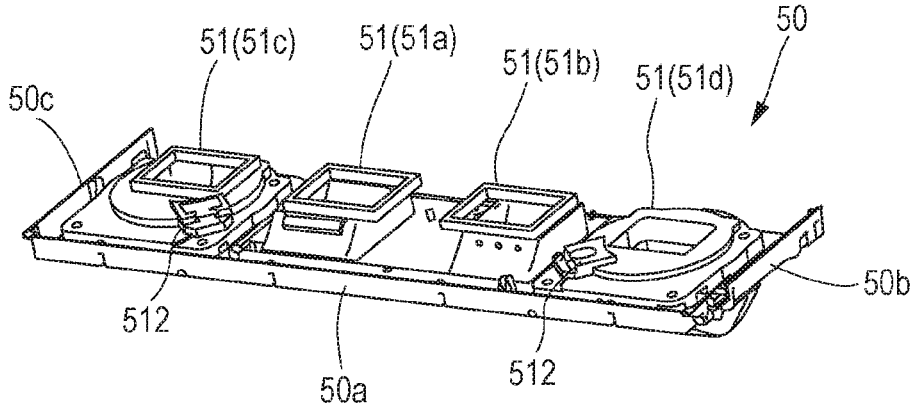
FIG. 14 is a perspective view illustrating a partition plate unit attached to the rear surface side of the decorative panel.

The partition plate unit 50 illustrated in FIG. 14 is attached to the rear surface 70R side of the decorative panel 70. Referring also to FIGS. 4, 9 and the like, the partition plate unit 50 includes four ducts 51 (51*a* to 51*d*) on the upper surface side (the surface facing the drain pan 40), which are respectively fitted to four ventilation holes 43 (43*a* to 43*d*; see FIG. 9) formed in the drain pan 40 to communicate with the blower 343 of the fan unit 30.

In this embodiment, the ventilation holes 43 (43*a* to 43*d*) are quadrangular holes, and the ducts 51 (51*a* to 51*d*) fitted into the ventilation holes 43 are quadrangular tubular shapes (square tubular shapes). These ducts 51 (51*a* to 51*d*) extend to the rear surface 70R of the decorative panel 70 as a rectangular tube shape.

The inner two ducts 51*a* and 51*b* are fitted into the corresponding ventilation holes 43*a* and 43*b* respectively, and the two ducts Mc and Md disposed outside are fitted into the corresponding ventilation holes 43*a* and 43*b* respectively.

Figure 15:
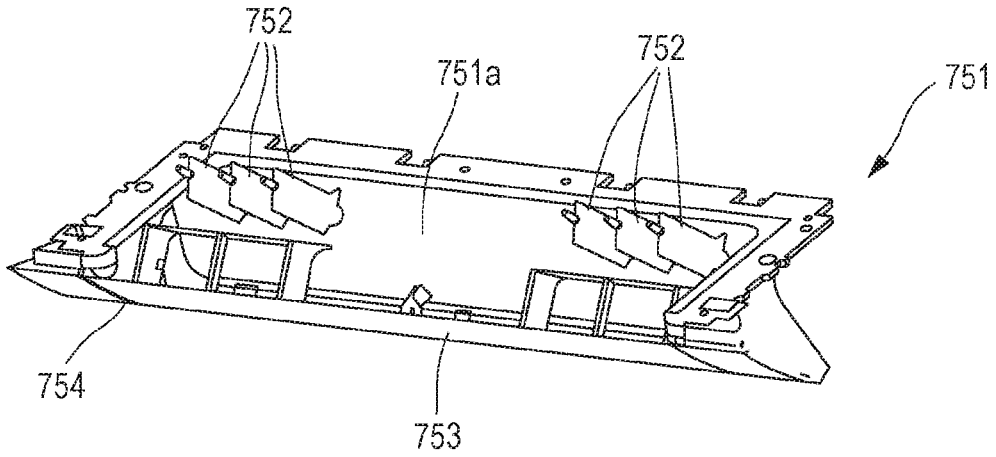
FIG. 15 is a perspective view illustrating a central air blowing unit attached to the partition plate unit.

The ducts Ma and Mb are ducts for the fixed air blowing portion 75, and as illustrated in FIG. 15, a central air blowing unit 751 having one chamber 751*a* allocated across the ducts Ma and Mb is attached on the lower surface side of the partition plate unit 50.

The left/right airflow direction vane 752 is provided in the chamber 751*a*. Further, the first air blowing opening 754 is formed on the front surface side of the central air blowing unit 751, and the up/down airflow direction vane 753 is provided therein.

Although not illustrated, a motor for driving the left/right airflow direction vane 752 is disposed on the back surface of the chamber 751*a*, and a motor for driving the up/down airflow direction vane 754 is disposed beside the first air blowing opening 754.

The outer ducts 51*c* and 51*d* are ducts for the movable air blowing portion 77, and as illustrated in FIG. 16, the rotation unit 78L of the left movable air blowing portion 77L is rotatably attached to the lower end of the left duct 51*c*. The rotation unit 78R of the right movable air blowing portion 77R is rotatably attached to the lower end of the right duct 51*d*.

Both the rotation units 78L and 78R are driven by a motor. The motor that drives the rotation unit 78 is disposed in a motor cover 512 illustrated beside the outer ducts 51*c* and 51*d* in FIG. 14.

In this embodiment, the rotation units 78L and 78R are respectively rotatable from the first position to the position of 90° or more, for example, 100° as the second position. However, when the rotation units are rotated to such a position, a short circuit phenomenon may occur in which the blown air is sucked into the air suction part 73 without going to the air conditioning room R.

To prevent this, referring to FIGS. 11 to 13, a wall 711 is provided between the rotation unit 78 and the air suction part 73.

In this embodiment, the wall 711 is formed in a slope shape in which a part of the panel portion 71 around the rotation unit 78 rises up from the short sides 70*c* and 70*d* to the height of the top surface 781 of the rotation unit 78 or the height of the air suction part 73 to face between the rotation units 78L and 78R and the air suction part 73. In FIGS. 11 to 13, it is illustrated that a ridge 711*a* of the wall 711 has a slope shape.

According to this, the short circuit phenomenon when the rotation unit 78 is rotated to the vicinity of the maximum rotation position by the wall 711 is prevented, and the blown air flow reaches farther along a slope surface 712 of the wall 711. That is, the wall 711 not only prevents the short circuit phenomenon, but also functions as an airflow guide surface that allows the blown air to reach farther by providing the slope surface 712.

According to this embodiment, since the air blown out from the first air blowing opening 754 and the second air blowing opening 783 flows along the panel surface of the decorative panel 70, the remaining panel surface 70S except for the air suction part 73 of the decorative panel 70 acts as an airflow guide surface including the slope surface 712 of the wall 711.

As described above, the decorative panel 70 is attached to the main unit 10 by fitting the side wall 72 into the bottom surface opening of the main unit 10 and screwing. In this embodiment, the air suction part 73 is disposed on the first air suction chamber S1 side, and at the time of assembly, as illustrated by the arrow in FIG. 6, the air guide path L is formed between a bottom surface 40R of the drain pan 40 (see FIGS. 3 and 9) and the rear surface 70R of the decorative panel 70 to guide a part of the air sucked from the air suction part 73 to the second air suction chamber S2.

In this air guide path L, the air heading for the second air suction chamber S2 passes between the ducts 51 and 51, but in order to secure a larger amount of ventilation, as illustrated in FIG. 9, a recess 46 that enlarges the cross-sectional area of the ventilation path L is formed on the bottom surface 40R of the drain pan 40 corresponding to between the ducts 51 and 51.

Figure 6:
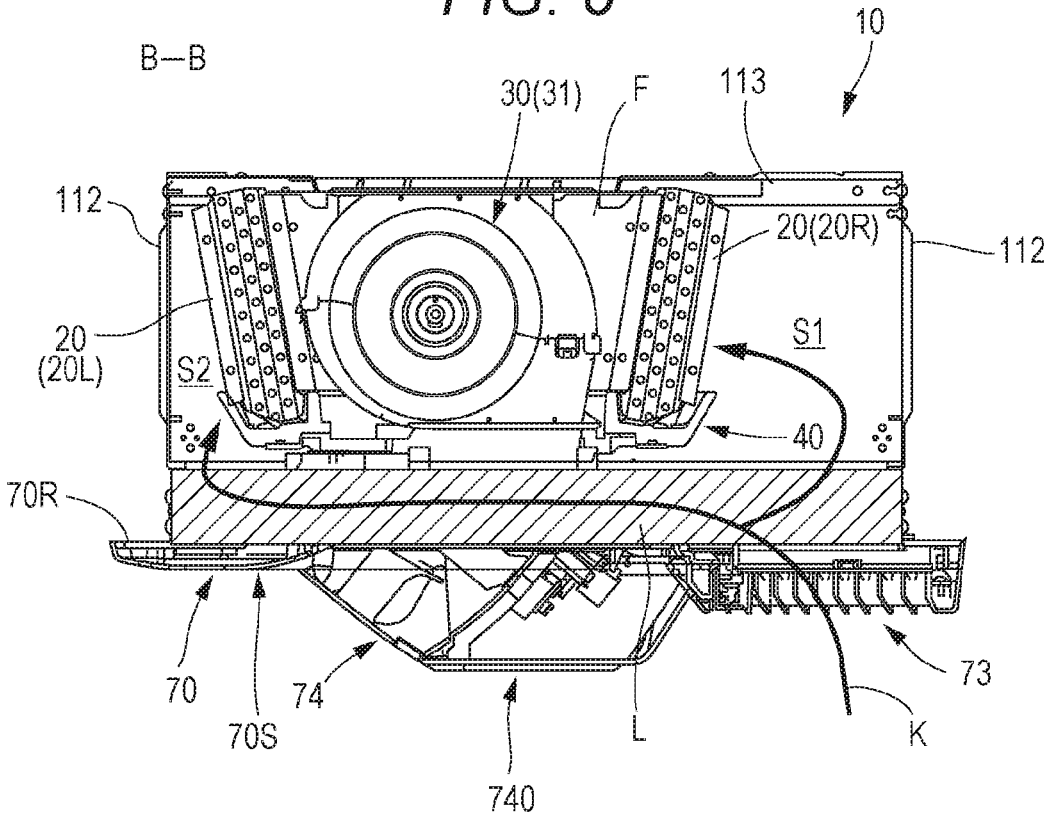
FIG. 6 is a schematic cross-sectional view taken along the line B-B of FIG. 2.
Figure 7:
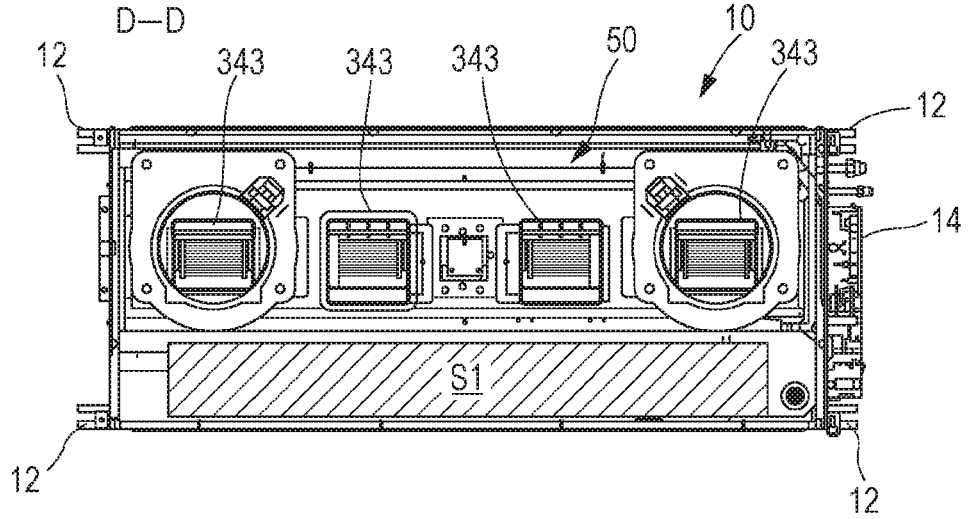
FIG. 7 is a schematic cross-sectional view taken along the line D-D in FIG. 4.
Figure 8:
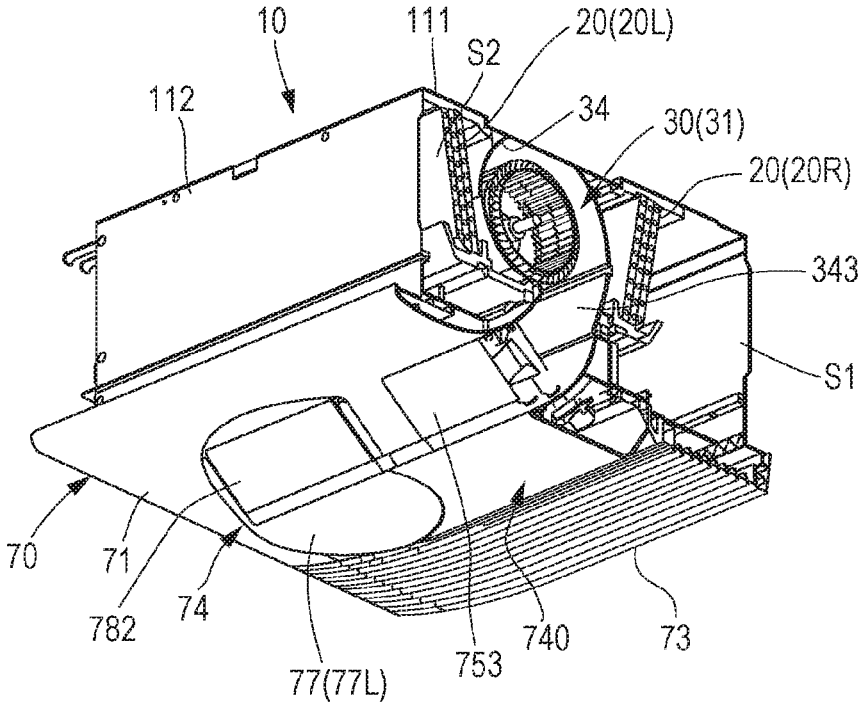
FIG. 8 is a perspective cross-sectional view taken along the line B-B of FIG. 2.

Further, in this indoor unit 1, as illustrated in FIGS. 4 and 6 described above, the decorative panel 70 is provided with the raised portion 740 including the fixed air blowing portion 75 and the movable air blowing portion 77, and the air guide path L having a larger vertical width can be secured between the drain pan 40 and the decorative panel 70 by forming the first air blowing opening 754 of the fixed air blowing portion 75 and the second air blowing opening 783 of the movable air blowing portion 77 in the side surface of the raised portion 740.

Further, referring to FIGS. 4 and 6 described above, the air suction part 73 is disposed so as to be included in the panel surface 70S of the decorative panel 70 above the raised portion 740 when viewed from the inside of the air conditioning room R. As a result, the air suction part 73 is positioned closer to the air guide path L, and a part of the air sucked from the air suction part 73 is easily moved to the second air suction chamber S2 side through the air guide path L.

<<Assembly>>

Next, the assembly of the indoor unit 1 will be described. In the main unit 10, first, the top plate 111 side of the outer trunk 11 is placed on an assembly table, and the heat insulating material 13 is fitted inside the outer trunk 11. Then, a gas connecting pipe and a liquid connecting pipe (both not illustrated) of the assembled heat exchanger 20 (the heat exchanger in which the front heat exchange part 20L and the rear heat exchange part 20R are connected by the connecting plate 21) are pulled out from the side plate 113. In this state, the heat exchanger 20 is fixed to the top plate 111 via a predetermined fixture (not illustrated). After that, the assembled fan unit 30 is disposed in the air blowing chamber F in the heat exchanger 20 and fixed to the top plate 111 via the motor mounting base 361 and the fan fixing part 341.

Next, the gutter 45 on the drain sheet 42 side of the drain pan 40 is fitted to the bottom surface of the outer trunk 11 in alignment with the lower ends of the heat exchange parts 20L and 20R. At this time, the blower 343 of the fan casing 34 is fitted into the ventilation hole 43 of the drain pan 40.

The main unit 10 assembled as described above and the decorative panel 70 are individually packaged and transported to the installation site. The main unit 10 is installed on the ceiling back space T2 by being suspended by a plurality of hanging bolts embedded in the ceiling back space T2 in advance.

Then, the decorative panel 70 is attached from the air conditioning room R side. At this time, the duct 51 of the partition plate unit 50 is connected to the blower 343 of the fan casing 34 via the ventilation hole 43 of the drain pan 40. Although not illustrated, the indoor unit 1 can be operated by connecting a refrigerant pipe, a power supply line, and a signal line to the outdoor unit.

<<Operations>>

When the indoor unit 1 is stopped, as illustrated in FIG. 11, the rotation units 78L and 78R of the movable air blowing portions 77L and 77R are set to the initial position such that their second air blowing openings 783 are oriented in the same direction (long side 70*a*) as the first air blowing opening 754 of the fixed air blowing portion 75 (first position), and both the first air blowing opening 754 and the second air blowing opening 783 are closed by the up/down airflow direction vanes 782 and 753.

Then, the compressor and the fan motor (both not illustrated) of the outdoor unit and the fan motor 36 of the indoor unit 1 start operating in response to a user command from a remote controller (not illustrated) or a command from the air conditioning system.

In the indoor unit 1, the blowing fan 31 rotates by the operation of the fan motor 36. Due to the rotation of the blowing fan 31, the air in the blower 343 of the blowing fan 31 is blown out, so that the inside of the air blowing chamber F becomes a negative pressure, and the air K in the air conditioning room R is sucked from the air suction part 73 provided in the decorative panel 70.

Referring to FIG. 6, the air K sucked from the air suction part 73 flows into the first air suction chamber S1 and also flows into the second air suction chamber S2 through the air guide path L. The air in the first air suction chamber S1 passes through the rear heat exchange part 20R, is heat-exchanged with the refrigerant, and enters the air blowing chamber F. Similarly, the air in the second air suction chamber S2 passes through the front heat exchange part 20L, is heat-exchanged with the refrigerant, and enters the air blowing chamber F.

The air thus conditioned is sent out by the rotation of the blowing fan 31 from the blower 343 of the fan casing 34 toward the fixed air blowing portion 75 and the movable air blowing portion 77 of the decorative panel 70 through the duct 51.

The conditioned air sent to the fixed air blowing portion 75 is blown out from the first air blowing opening 754 in the direction guided by the left/right airflow direction vane 752 and the up/down airflow direction vane 753. In addition, the conditioned air sent to the movable air blowing portion 77 is blown out in the rotation direction of the rotation unit 78 and the direction guided by the up/down airflow direction vane 782.

Since the rotation units 78L and 78R can individually control the rotation, the conditioned air can be supplied in multiple directions except the direction of the long side 70*b* on the rear side where the air suction part 73 is provided, according to the user's request.

<<Support Structure of Partition Plate Unit>>

The indoor unit 1 according to this embodiment includes the partition plate unit 50 illustrated in FIG. 14 on the rear surface 70R of the decorative panel 70, as described above. The partition plate unit 50 is attached to the air blowing part 74 of the decorative panel 70, but is large and heavy because the fixed air blowing portion 75, the movable air blowing portion 77, and the like are provided.

Figure 17:
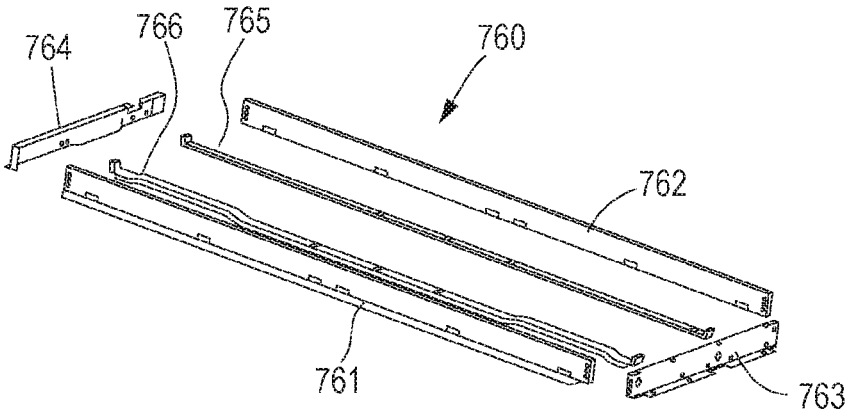
FIG. 17(*a*) is an exploded perspective view illustrating a frame that supports the partition plate unit, and FIG. 17(*b*) is a perspective view illustrating a state in which the frame is disposed on the rear surface of the decorative panel.
Figure 17:
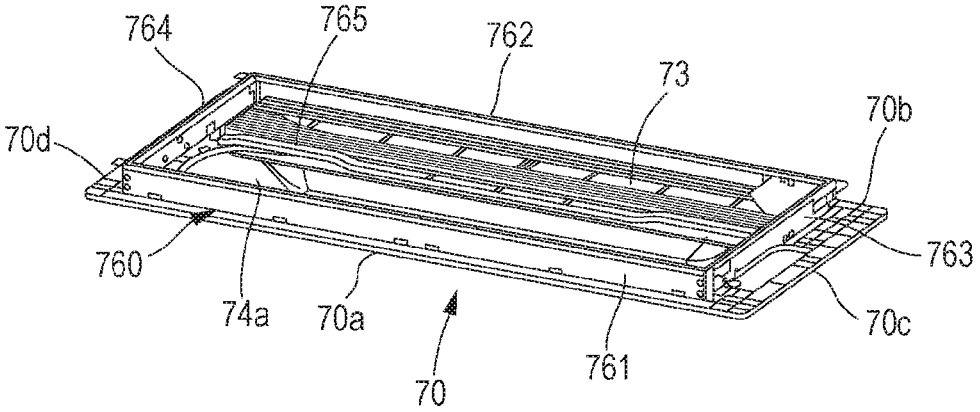

The frame 721 described in FIGS. 10(*a*) and 10(*b*) is provided on the rear surface of the decorative panel 70 for the purpose of preventing damage due to impact such as dropping, but here, as illustrated in FIGS. 17(*a*) and 17(*b*), a frame 760 is provided on the rear surface 70R side of the decorative panel 70 to support the partition plate unit 50.

As illustrated in FIG. 17(*a*), the frame 760 is a main frame, and includes long side frames 761 and 762 disposed respectively along the long sides 70*a* and 70*b* of the decorative panel 70, and short side frames 763 and 764 disposed respectively along the short sides 70*c* and 70*d* of the decorative panel 70 between both ends of the long side frames 761 and 762.

Two beams 765 and 766 are suspended between the short side frame 763 and the short side frame 764. The long side frames 761 and 762, the short side frames 763 and 764, and the beams 765 and 766 are preferably made of sheet metal.

As illustrated in FIG. 17(*b*), on the decorative panel 70, the partition plate unit 50 is attached so that the fixed air blowing portion 75 and the movable air blowing portion 77 project toward the air conditioning room R side such that an opening 74*a* forming the air blowing part 74 is formed along the long side 70*a* of the decorative panel 70.

The beams 765 and 766 are disposed on the long side of the opening 74*a* in which the air blowing part 74 is provided, respectively, and the partition plate unit 50 is supported by the beams 765 and 766 on the rear surface 70R side of the decorative panel 70.

The partition plate unit 50 is mounted on the rear surface 70R of the decorative panel 70 in a state of being fitted into the frame 760 such that three edges of a front edge 50*a*, a right edge 50*b*, and a left edge 50*c* are surrounded by the front long side frame 761 and the left and right short side frames 763 and 764. As a result, the beams 765 and 766 are sandwiched between the partition plate unit 50 and the rear surface 70R of the decorative panel 70.

According to this, the partition plate unit 50 can be mounted on the rear surface of the decorative panel 70 without deforming or distorting the decorative panel 70.

<<Configuration of Movable Air Blowing Portion>>

Figure 18:
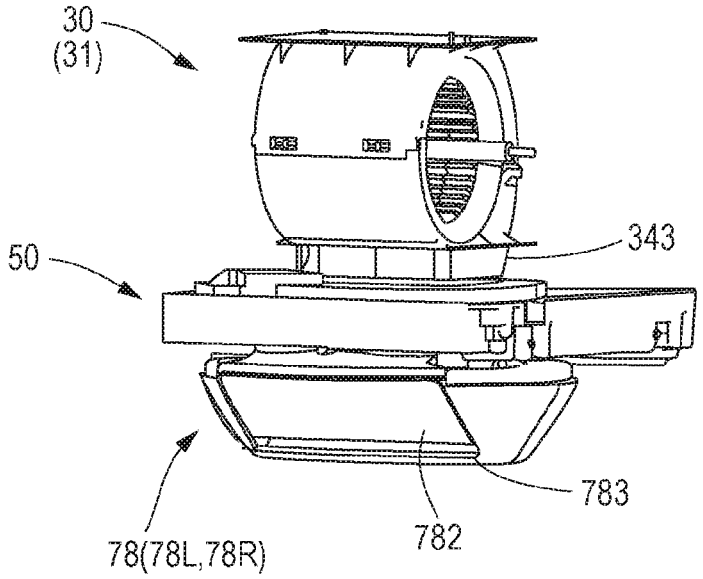
FIG. 18 is an external perspective view illustrating a fan unit and a movable air blowing portion.

As illustrated in FIG. 18, the fan unit 30 and the rotation unit 78 (78L, 78R) are connected through the partition plate unit 50 so that air can circulate. However, as illustrated in the exploded perspective view of FIG. 19, the partition plate unit 50 is provided with the driver 600 for rotating the rotation unit 78. The driver 600 is provided in each of the rotation units 78L and 78R, but the configuration is the same.

Figure 20:
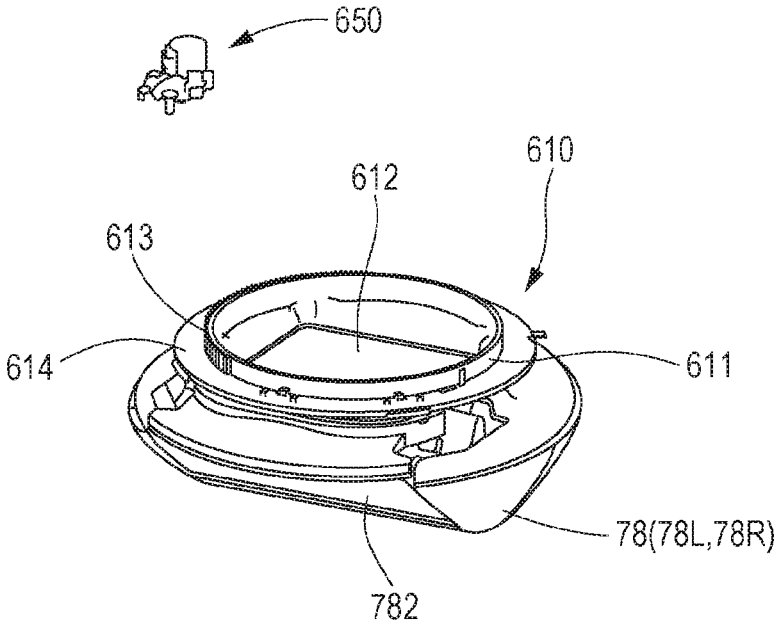
FIG. 20 is a perspective view illustrating a rotation unit to which a rotation ring is attached.
Figure 21:
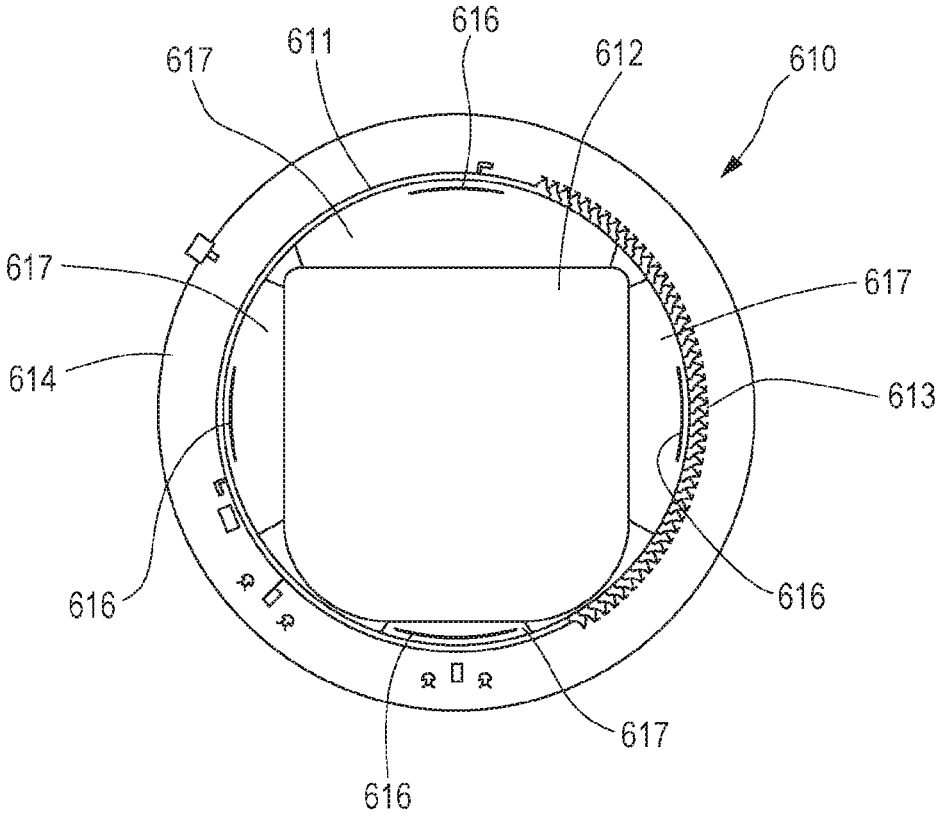
FIG. 21 is a plan view illustrating the rotation ring.

With reference to FIGS. 20 and 21 together, the driver 600 includes an annular rotation ring 610 integrally connected to the upper portion of the rotation unit 78, and a motor unit 650 that rotates the rotation ring 610.

The rotation ring 610 has a cylindrical portion 611, and rack teeth 613 are formed on the outer circumference of the cylindrical portion 611 along the arc surface of the outer circumference. The rack teeth 613 may be formed over the entire circumference of the cylindrical portion 611, but may be formed in a range that realizes at least the rotation range of the rotation unit 78 (the range between the first position and the second position described above).

Further, a flange 614 is formed concentrically on the outer circumference of the cylindrical portion 611 toward the outer side in the radial direction. Hereinafter, this flange 614 will be referred to as an outer flange. Inside the cylindrical portion 611, a vent hole 612 communicating with the duct 51 (51*c*, 51*d*) for the movable air blowing portion is formed in a rectangular shape.

Figure 22:
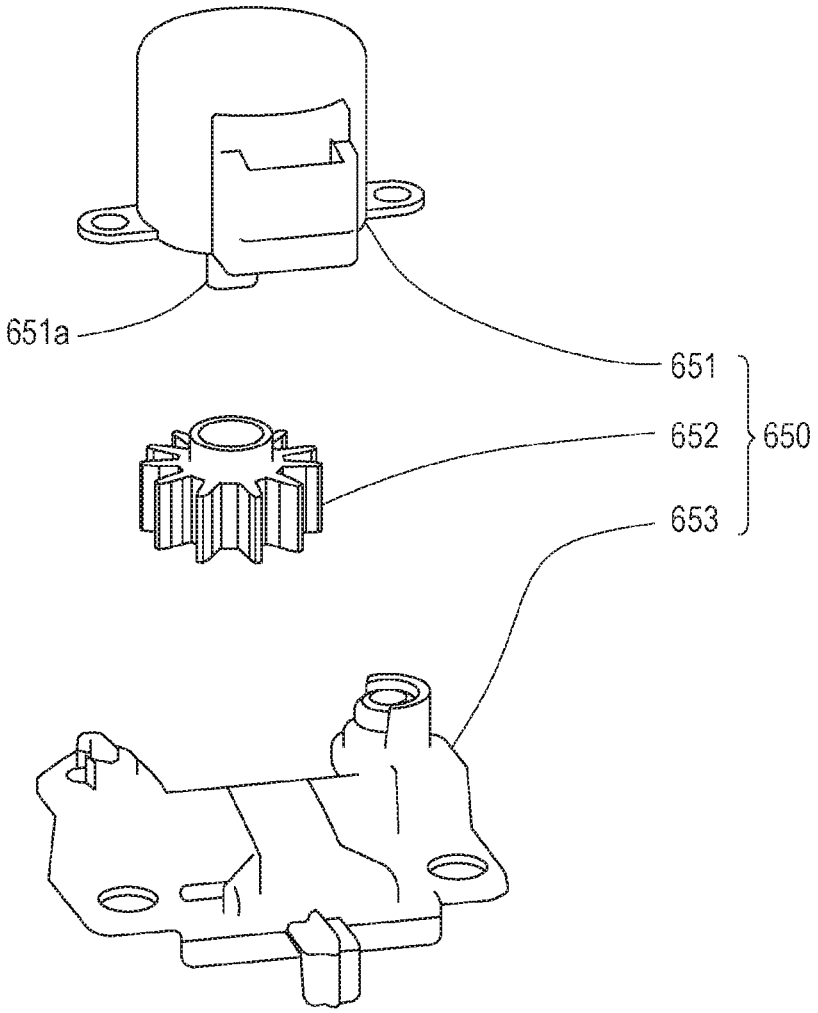
FIG. 22 is an exploded perspective view illustrating a motor unit.

As illustrated in FIG. 22, the motor unit 650 has a motor (preferably a stepping motor) 651 capable of forward and reverse rotation, a pinion gear 652 attached to its output shaft 651*a*, and a mount 653 for attachment. The pinion gear 652 is attached to a predetermined portion of a duct cover 630 described later so as to mesh with the rack teeth 613 of the rotation ring 610.

Figure 19:
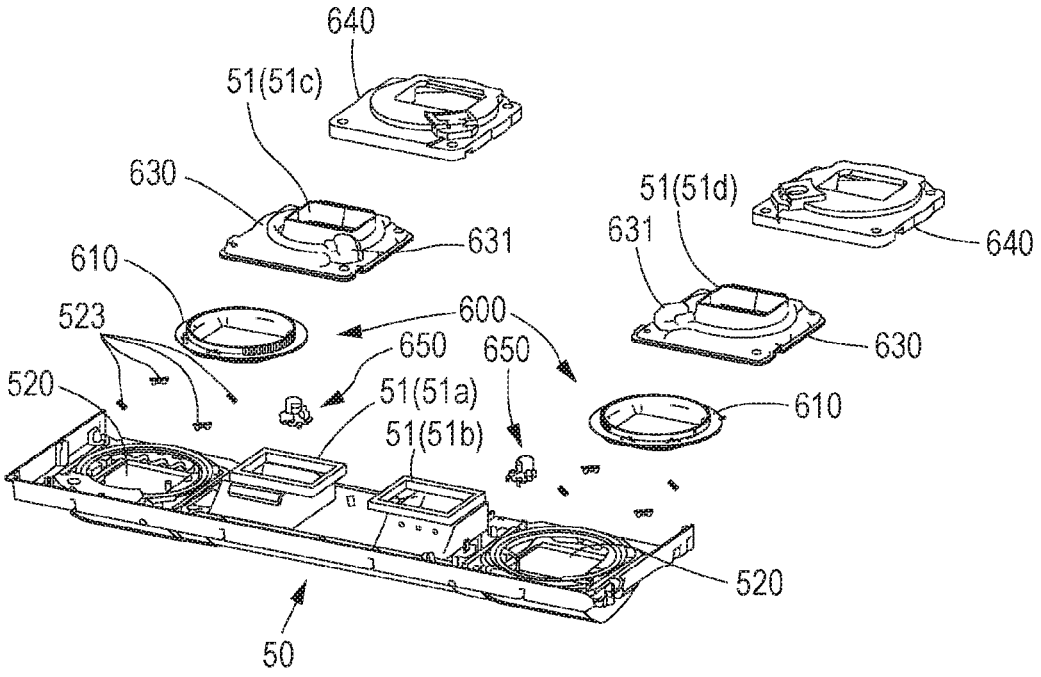
FIG. 19 is an exploded perspective view illustrating a partition plate unit including a driver of the rotation unit.
Figure 23:
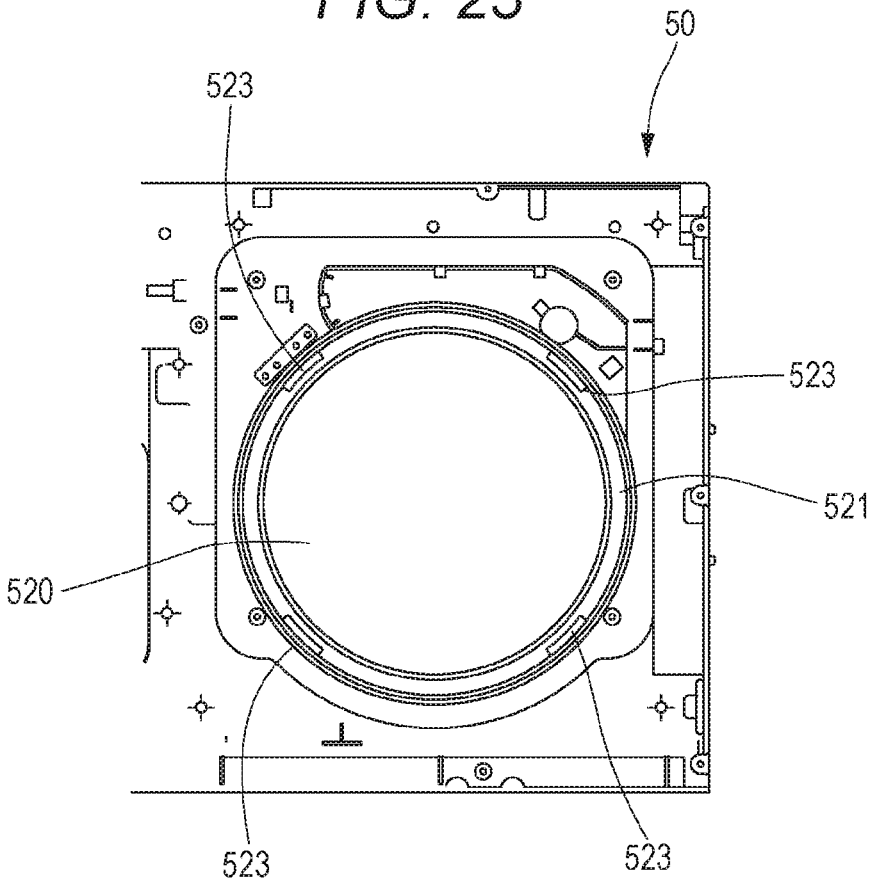
FIG. 23 is a plan view illustrating a part of the partition plate unit including an opening to which the rotation ring is attached.

With reference to FIGS. 19 and 23, circular openings 520 into which the rotation rings 610 are fitted are formed on both sides of the partition plate unit 50. A flange 521 is formed concentrically on the inner periphery of the opening 520 toward the inner side in the radial direction. Hereinafter, this flange 521 is referred to as an inner flange.

When the rotation ring 610 is fitted into the opening 520, the outer flange 614 is disposed on the inner flange 521, and the outer flange 614 slides on the inner flange 521 as the rotation ring 610 rotates. The outer flange 614 and the inner flange 521 function as a kind of thrust bearing that receives a load in the axial direction of the rotating body.

After the rotation ring 610 is fitted into the opening 520, the duct cover 630 is put on to hold the rotation ring 610. The duct cover 630 is screwed to the partition plate unit 50.

As described above, the duct cover 630 is formed with the duct 51 (51*c*, 51*d*) connected to the ventilation hole 43 formed in the drain pan 40. Further, the duct cover 630 is formed with a pedestal 631 to which the motor unit 650 is attached.

Figure 27:
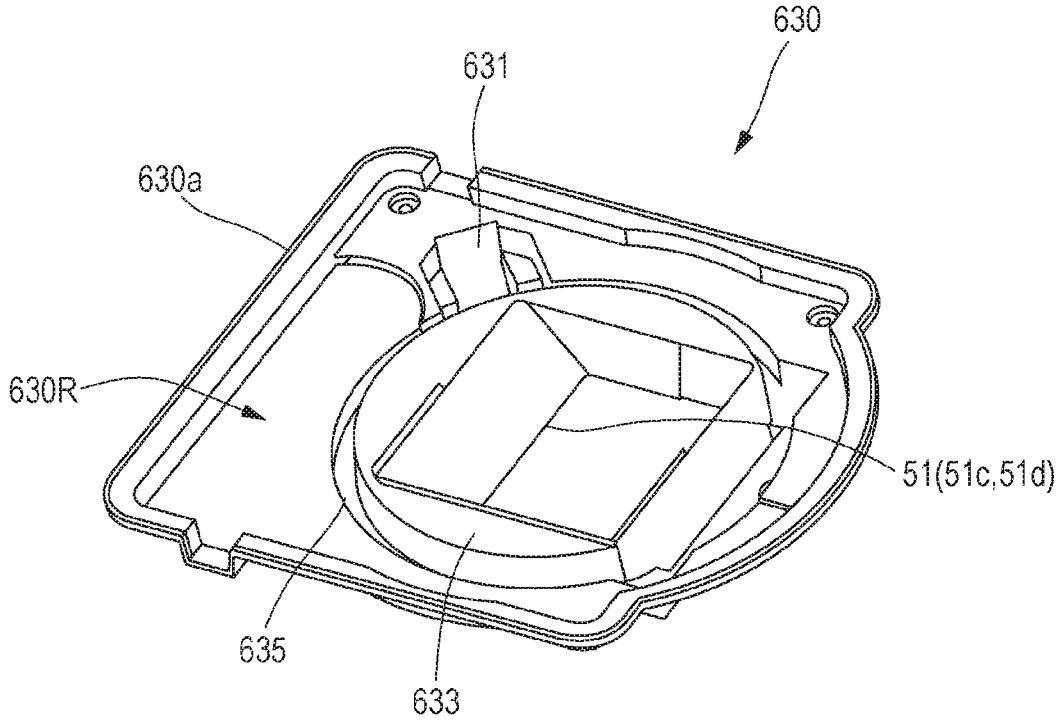
FIG. 27 is a perspective view illustrating the rear surface side of a duct cover.

As illustrated in FIG. 27, an annular guide groove 635 into which the cylindrical portion 611 of the rotation ring 610 is fitted is formed on the rear surface 630R of the duct cover 630. Further, the circular portion surrounded by the guide groove 635 on the rear surface 630R of the duct cover 630 becomes an inner bottom surface 633 having a height slightly lower than an edge 630*a* of the duct cover 630 in FIG. 27 (slightly higher than the edge 630*a* in the cross-sectional view of FIG. 28).

The duct 51 (51*c*, 51*d*) has a rectangular shape, but its ventilation area (cross-sectional area) is gradually expanded from the upper surface of the duct cover 630 toward the inner bottom surface 633, and the apex (corner) is widened on the inner bottom surface 633 so as to be in contact with the annular guide groove 635. The rotation ring 610 rotates along the circumscribed circle of the duct 51 on the inner bottom surface 633 side.

In the ventilation path from the fan unit 30 to the second air blowing opening 783 of the rotation unit 78, the blowing pressure changes at the rotating portion of the rotation unit 78, but as described above, the rotation ring 610 is rotated along the circumscribed circle of the ducts 51 on the inner bottom surface 633 side, so that the pressure change in the rotation portion of the rotation unit 78 can be reduced since the blowing path is not blocked even partially. Further, the structure of the joint portion (connecting portion) between the rotation ring 610 and the duct 51 can be downsized.

The rotation ring 610 does not have to be in contact with the four apexes of the duct 51. For example, the rotation ring 610 is a large circle that is in contact with two adjacent apexes of the duct 51 on the inner bottom surface 633 side, and can be rotated without reducing the ventilation area of the duct 51 (without blocking a part of the duct).

Referring again to FIG. 19, according to this embodiment, the duct cover 630 is further covered with an outer cover 640. The outer cover 640 is slightly larger than the duct cover 630, but may be omitted depending on the case.

When the air blowing direction of the rotation unit 78 changes, the rotation ring 610 is rotated in the opening 520 by the motor 651. It is necessary to prevent the rotation ring 610 from rattling during this rotation. The rattling includes the rattling in the horizontal direction (radial direction) and the rattling in the vertical direction (axial direction).

Figure 24:
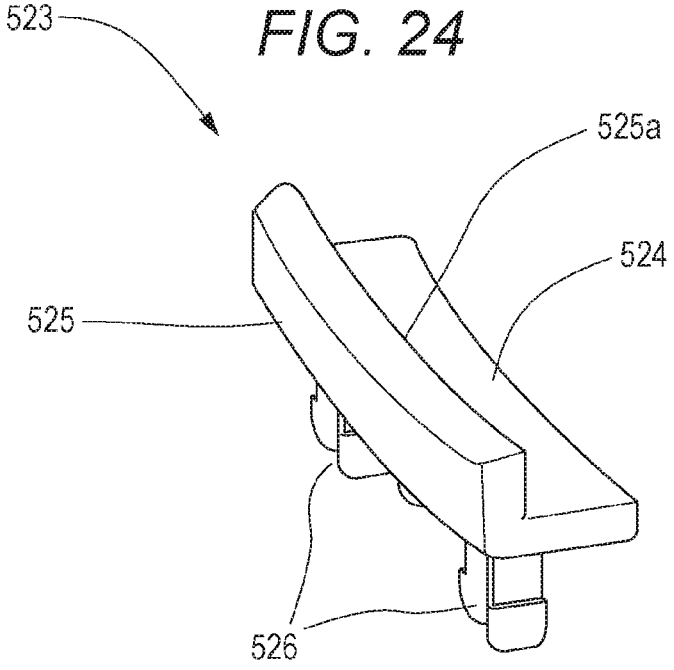
FIG. 24 is a perspective view illustrating a stable seat for preventing lateral rattling of the rotation ring.

First, in order to prevent rattling in the lateral direction (radial direction), a stable seat 523 illustrated in FIG. 24 is used. The stable seat 523 has a flat seat portion 524 and a side wall 525 that rises substantially vertically from one end of the seat portion 524, and elastically deformable mounting legs 526 which are slotted are provided in the bottom portion of the seat portion 524. The side wall 525 has an arc surface 525*a* formed along the outer peripheral edge 614*a* of the outer flange 614.

The stable seats 523 are preferably formed of a low friction resin such as polyacetal (POM), and in this example, as illustrated in FIG. 23, there are provided the seats at four positions on the outer peripheral side of the inner flange 521 at 90° intervals. As another example, the seats may be provided at three locations at 120° intervals. Further, when the length of the stable seat 523 (the length along the circumferential direction of the inner flange 521) is long, it may be disposed at two positions.

Figure 25:
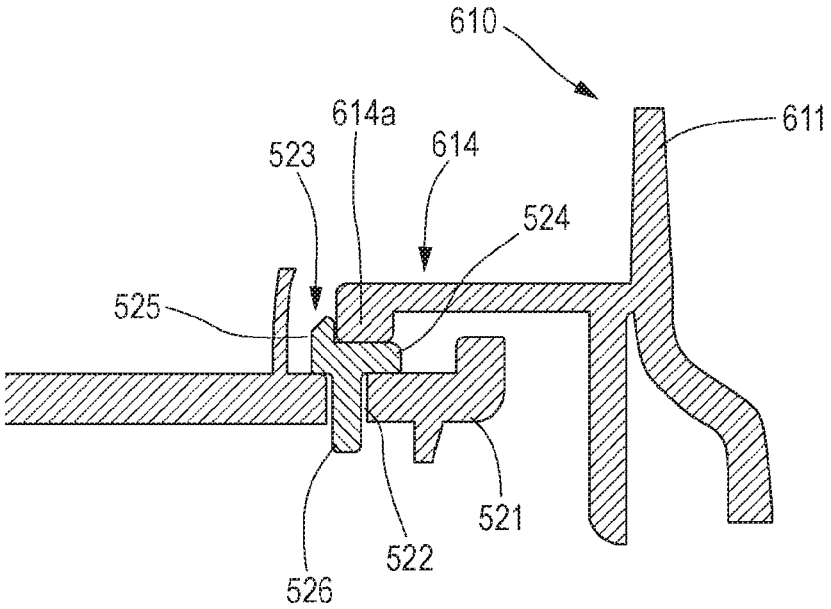
FIG. 25 is a cross-sectional view illustrating a state in which the stable seat is attached.

The stable seat 523 is attached to the inner flange 521 along the outer peripheral edge 614*a* of the outer flange 614 of the rotation ring 610. However, in order to attach the stable seat 523, as illustrated in FIG. 25, an engagement hole 522 is provided in the inner flange 521 to be projected, and the mounting legs 526 may be pushed into the engagement hole 522 while elastically deforming.

Thus, by providing the stable seats 523 on the inner flange 521 side in contact with the outer peripheral edge 614*a* of the outer flange 614 at a plurality of positions, it is possible to prevent the rotation ring 610 from rattling in the lateral direction (radial direction).

Figure 26:
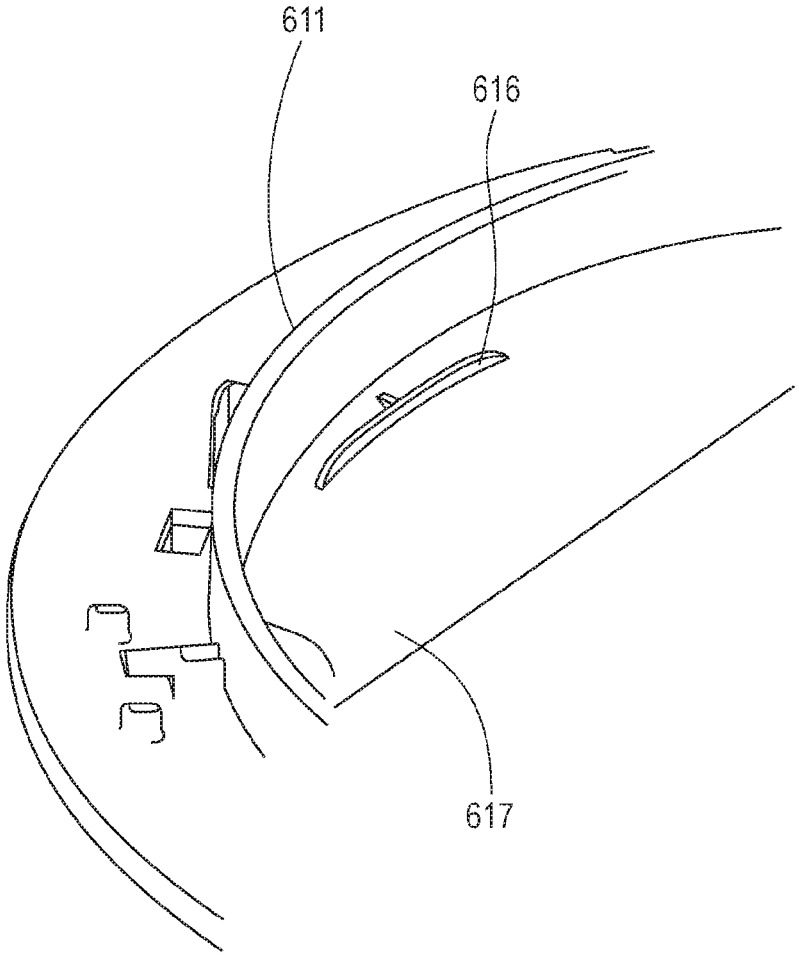
FIG. 26 is a perspective view illustrating a protruding piece for preventing vertical rattling of the rotation ring.

Next, in order to prevent rattling in the vertical direction (axial direction), as illustrated in FIG. 26, a protruding piece 616 is provided inside the cylindrical body 611 of the rotation ring 610. As described above, since the vent hole 612 formed in the cylindrical portion 611 has a rectangular shape, an inner wall 617 forming each side of the rectangular shape exists inside the cylindrical portion 611. The protruding piece 616 is erected on the inner wall 617.

The position of the protruding piece 616 is such that it can abut on the inner bottom surface 633 on the rear surface 630R of the duct cover 630 illustrated in FIG. 27. In this example, the inner bottom surface 633 is disposed along three sides of the rectangular opening of the duct 51, and the protruding pieces 616 are provided at 90° intervals at four positions as illustrated in FIG. 21.

According to this, since the three protruding pieces 616 are always on the inner bottom surface 633 regardless of the rotational position of the rotation ring 610, the protruding pieces 616 do not come off from the inner bottom surface 633. However, in order to reduce the sliding frictional resistance, it is preferable that the contact area of each protruding piece 616 with respect to the inner bottom surface 633 is as small as possible.

Figure 28:
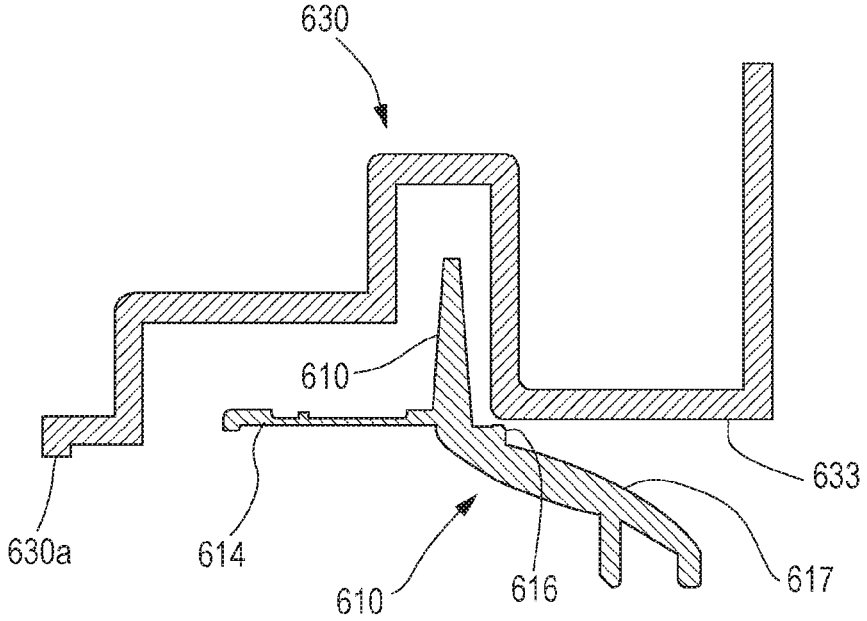
FIG. 28 is a cross-sectional view illustrating the function of lateral rattling of the rotation ring due to the protruding piece.

Further, as illustrated in FIG. 28, the projecting height of the protruding piece 616 is such that the tip end of the protruding piece 616 abuts on the inner bottom surface 633 when the duct cover 630 is put on the rotation ring 610.

As described above, by providing the protruding piece 616 that abuts on the inner bottom surface 633 on the rear surface 630R of the duct cover 630 inside the cylindrical body 611 of the rotation ring 610, it is possible to prevent the rotation ring 610 from rattling in the vertical direction (axial direction).

As described above, the rotation ring 610 rotates in the opening 520 of the partition plate unit 50 by the motor 651, but it is necessary to take a measure for preventing air leakage from the gap between the inner flange 521 on the opening 520 side and the outer flange 614 on the rotation ring 610 side, and especially a measure for preventing dew condensation during cooling operation.

Figure 29:
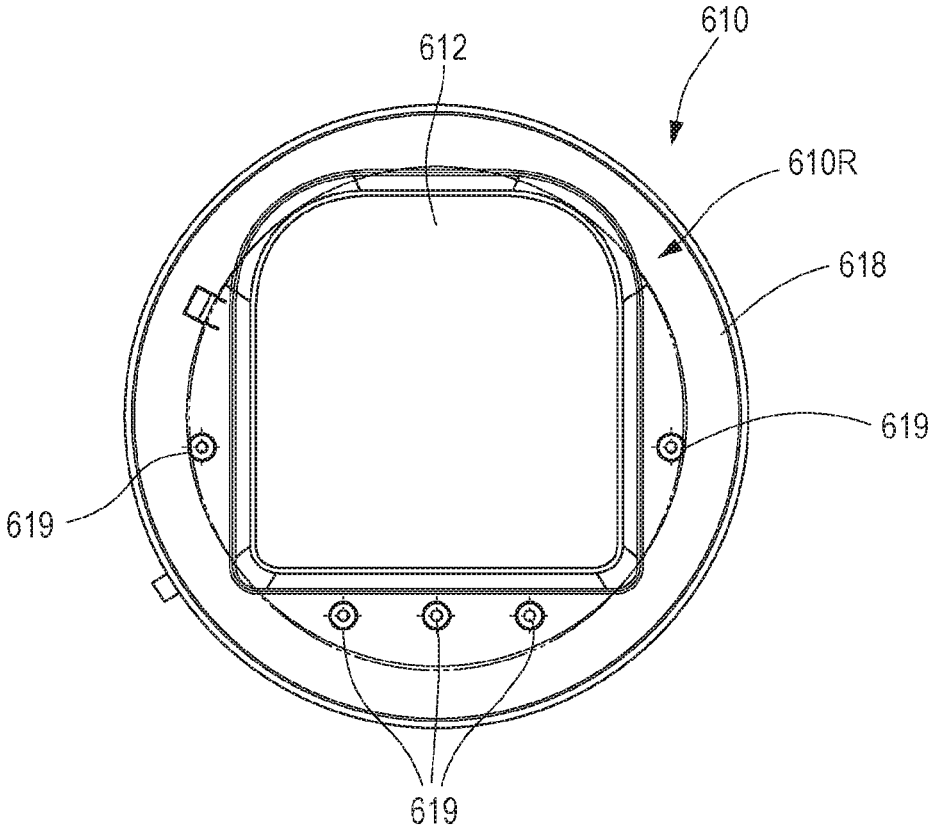
FIG. 29 is a bottom view illustrating the rotation ring.
Figure 30:
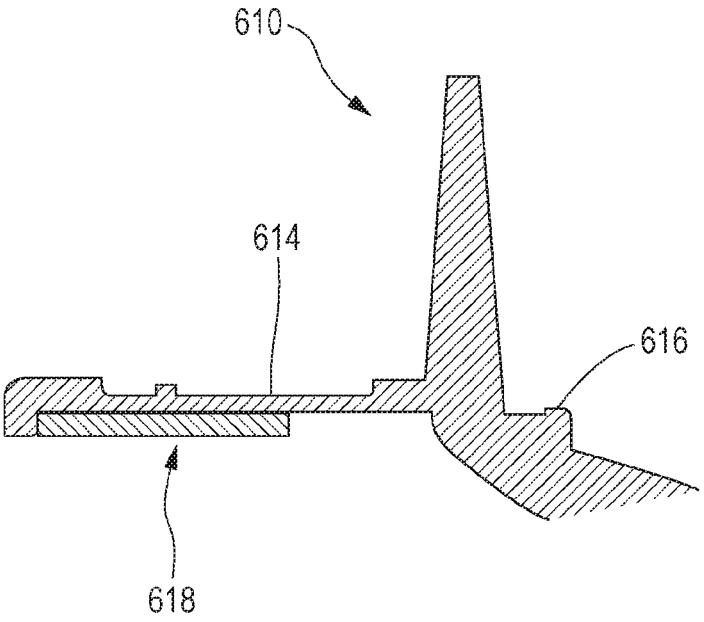
FIG. 30 is a cross-sectional view illustrating an outer flange of the rotation ring to which a sealing material is attached.

Therefore, in this example, as illustrated in FIGS. 29 and 30, the sealing material 618 is provided on the inner surface of the outer flange 614 (the surface side facing the inner flange 521). The sealing material 618 only needs to have appropriate elasticity and heat insulating properties, but since it is rubbed by the inner flange 521 as the rotation ring 610 rotates, a tape or sheet obtained by planting on a tape-shaped or sheet-shaped base material with a low-friction fiber such as a fiber made of polyacetal (often short fiber) is preferably employed.

According to this, the clearance between the inner flange 521 and the outer flange 614 can be substantially 0 to 0.5 mm to prevent air leakage. Further, it is possible to adopt a structure in which dew condensation does not occur. Further, the sliding frictional resistance due to the rotation of the rotation ring 610 can be reduced.

As illustrated in FIG. 29, on the rear surface 610R side of the rotation ring 610, bosses 619 used when connecting the rotation unit 78 are provided at a plurality of positions.

<<Configuration of Fan Unit>>

In the fan unit 30 described in FIG. 3 above, the blowing fan 31 is fixed to the top plate 111 of the outer trunk 11 via the fan mounting base 311 provided in the fan casing 34, and the fan motor 36 is also fixed to the top plate 111 of the outer trunk 11 via the motor mounting base 361. Therefore, a large number of parts are used, and high positioning accuracy is required for positioning the blowing fan 31 and the fan motor 36.

Figure 31:
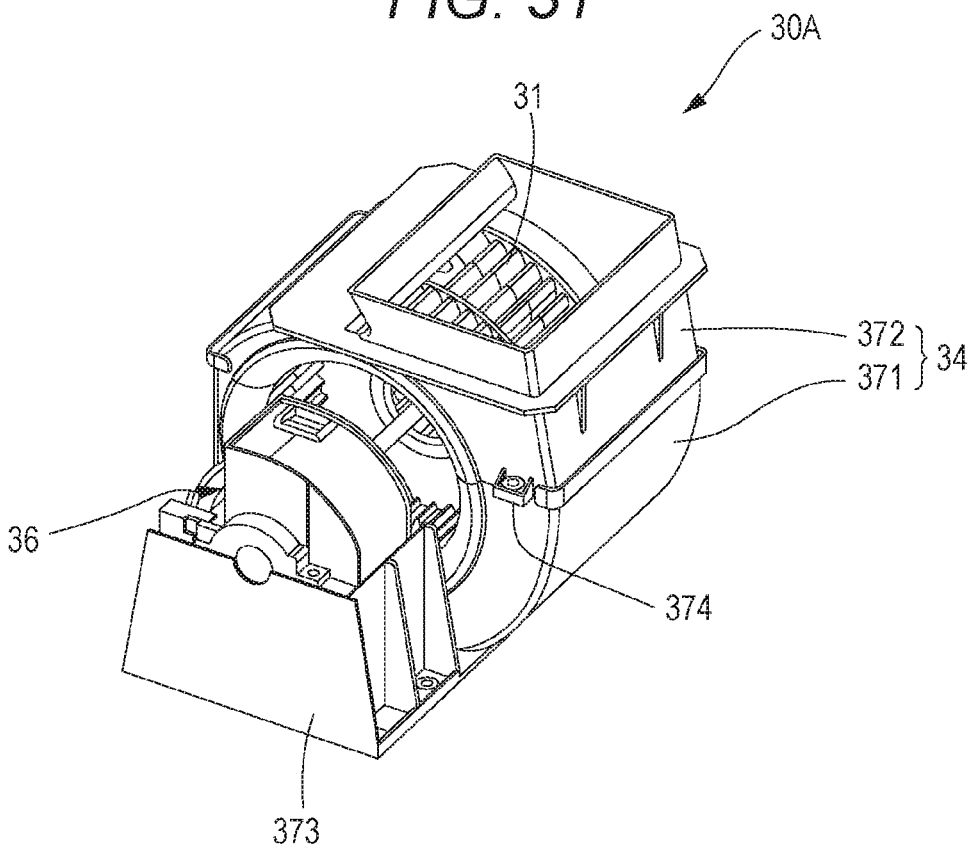
FIG. 31 is a perspective view illustrating an improved fan unit.
Figure 32:
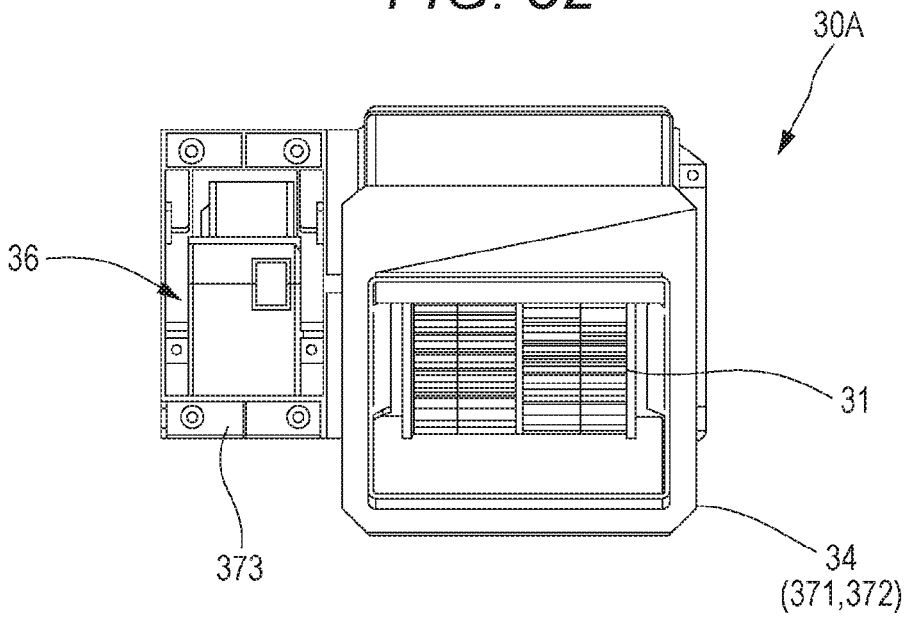
FIG. 32 is a plan view illustrating the fan unit.

FIGS. 31 and 32 illustrate a fan unit 30A improved in this respect. Also in this embodiment, a sirocco fan is preferably used as the blowing fan 31, and the fan motor 36 is also used without any change.

In this fan unit 30A, the fan casing 34 of the blowing fan 31 is divided into two parts, a lower casing 371 and an upper casing 372, both made of a synthetic resin material, but a motor mounting base 373 of the fan motor 36 is integrally formed in the lower casing 371.

A bearing supporting the blowing fan 31 of the lower casing 371 and a bearing supporting the fan motor 36 of the motor mounting base 373 (both not illustrated) are preliminarily cored when the motor mounting base 373 is integrally molded on the lower casing 371. The upper casing 372 may be fixed to the lower casing 371 by a locking tool 374 such as a snap lock.

According to this fan unit 30A, the blowing fan 31 and the fan motor 36 are connected in advance, the upper casing 372 is opened, the blowing fan 31 is housed in the lower casing 371, and the fan motor 36 is set on the motor mounting base 373. The positions of the blowing fan 31 and the fan motor 36 can be easily adjusted (centered).

Further, it is not necessary to separately fix the outer trunk 11 to the top plate 111 with the blowing fan 31 and the fan motor 36, and only the mounting portion (not illustrated) provided on the lower casing 371 is fixed to the top plate 111.

Further, since this fan unit 30A is unitized by a minimum unit, it is sufficient to select the number of units to be used according to the amount of blown air required for the air conditioner, the size of the air blowing part, or the like. There is no need to design a dedicated fan unit (air blower) for each of models different in the amount of air. According to this fan unit 30A, since the air volume can be adjusted individually, more detailed air conditioning operation can be performed.

LIST OF REFERENCE SIGNS

1 Indoor unit
10 Main unit
11 Outer trunk
111 Top plate
112, 113 Side plate
12 Mounting bracket
13 Heat insulating material
20 Heat exchanger
20L Front heat exchange part
20R Rear heat exchange part
21 Connecting plate
30 Fan unit
31 Blowing fan
32 Impeller
33 Blowing path
34 Fan casing
343 Blower
35 Rotating shaft
36 Fan motor
371 Lower casing
372 Upper casing
373 Motor mounting base
40 Drain pan
43 Ventilation hole
45 Gutter
50 Partition plate unit
51 (51*a* to 51*d*) Duct
520 Opening
521 Inner flange
523 Stable seat
600 Driver
610 Rotation ring
611 Cylindrical portion
612 Vent hole
613 Rack teeth
614 Outer flange
616 Protruding piece
618 Sealing material
630 Duct cover
633 Inner bottom surface
635 Guide groove
70 Decorative panel
70*a*, 70*b* Long side
70*c*, 70*d* Short side
71 Panel portion
71*a* Panel body
71*b* Side panel
711 Wall
712 Slope surface
72 Side wall
721, 760 Frame
722, 765, 766 Beam
73 Air suction part
74 Air blowing part
740 Raised portion
75 Fixed air blowing portion
751 Central air blowing unit
754 First air blowing opening
77 (77L, 77R) Movable air blowing portion
78 (78L, 78R) Rotation unit
783 Second air blowing opening
R Air conditioning room
T1 Ceiling
T2 Ceiling back space
F Air blowing chamber
S1, S2 Air suction chamber
L Air guide path

The invention claimed is:

1. A ceiling-embedded air conditioner, comprising:

a box-shaped main unit that includes an air blower, a heat exchanger, and a drain pan and is disposed in a ceiling of an air conditioning room; and a decorative panel that is attached to a bottom surface of the main unit along a ceiling surface of the air conditioning room, the decorative panel being provided with an air suction part and an air blowing part, wherein the heat exchanger includes at least two heat exchange parts of a front heat exchange part and a rear heat exchange part, the front heat exchange part and the rear heat exchange part being disposed in the main unit so as to face each other, wherein an air blowing chamber is provided between the front heat exchange part and the rear heat exchange part, wherein a first air suction chamber is provided outside the rear heat exchange part, wherein a second air suction chamber is provided outside the front heat exchange part, wherein the air suction part is disposed on a side of the first air suction chamber, wherein the air blower is housed in the air blowing chamber, wherein a bottom surface of the air blowing chamber is closed by the drain pan, wherein an air guide path is formed in a configuration to guide air from the air suction part on the side of the first air suction chamber to the second air suction chamber on a side of the front heat exchange part between the decorative panel and the drain pan, wherein a ventilation hole is formed in the drain pan, wherein a plurality of ducts is provided in the decorative panel to be fitted into the ventilation hole so as to guide air blown out from the air blower to the air blowing part, wherein the air guide path is formed between a first duct and a second duct of the plurality of ducts, and wherein a recess is formed in a bottom surface of the drain pan corresponding to the air guide path to expand a cross-sectional area of the air guide path.

2. The ceiling-embedded air conditioner according to claim 1, wherein the air blowing part includes a raised portion that projects toward the air conditioning room rather than a panel surface of the decorative panel, and wherein the air blowing part is formed with an air blowing opening in a side surface of the raised portion to blow out air blown out from the air blower along the panel surface of the decorative panel.

3. The ceiling-embedded air conditioner according to claim 2, wherein the air suction part is disposed so as to be included in the panel surface of the decorative panel above the raised portion when viewed from the air conditioning room.

4. The ceiling-embedded air conditioner according to claim 1, wherein a distance from a rotating shaft that is a center of the air blower to the front heat exchange part is L1, and a distance from the rotating shaft that is the center of the air blower to the rear heat exchange part is L2, and L1<L2 is satisfied.

5. The ceiling-embedded air conditioner according to claim 1, wherein the air blower includes a fan motor, an impeller driven by the fan motor, and a fan casing surrounding the impeller, and wherein a side of the fan casing that faces the front heat exchange part is formed in a horizontal plane.

6. The ceiling-embedded air conditioner according to claim 1, wherein a distance between an upper end of the front heat exchange part and an upper end of the rear heat exchange part is larger than a distance between a lower end of the front heat exchange part and a lower end of the rear heat exchange part.

7. The ceiling-embedded air conditioner according to claim 1, wherein the air blowing part includes a raised portion that projects toward the air conditioning room rather than a panel surface of the decorative panel, and is formed with an air blowing opening in a side surface of the raised portion to blow out air blown out from the air blower along the panel surface of the decorative panel.

8. The ceiling-embedded air conditioner according to claim 1, wherein a distance from a rotating shaft that is a center of the air blower to the front heat exchange part is L1, and a distance from the rotating shaft that is the center of the air blower to the rear heat exchange part is L2, and L1<L2 is satisfied.

9. The ceiling-embedded air conditioner according to claim 2, wherein a distance from a rotating shaft that is a center of the air blower to the front heat exchange part is L1, and a distance from the rotating shaft that is the center of the air blower to the rear heat exchange part is L2, and L1<L2 is satisfied.

10. The ceiling-embedded air conditioner according to claim 3, wherein a distance from a rotating shaft that is a center of the air blower to the front heat exchange part is L1, and a distance from the rotating shaft that is the center of the air blower to the rear heat exchange part is L2, and L1<L2 is satisfied.

11. The ceiling-embedded air conditioner according to claim 1, wherein the air blower includes a fan motor, an impeller driven by the fan motor, and a fan casing surrounding the impeller, and a side of the fan casing that faces the front heat exchange part is formed in a horizontal plane.

12. The ceiling-embedded air conditioner according to claim 2, wherein the air blower includes a fan motor, an impeller driven by the fan motor, and a fan casing surrounding the impeller, and a side of the fan casing that faces the front heat exchange part is formed in a horizontal plane.

13. The ceiling-embedded air conditioner according to claim 3, wherein the air blower includes a fan motor, an impeller driven by the fan motor, and a fan casing surrounding the impeller, and a side of the fan casing that faces the front heat exchange part is formed in a horizontal plane.

14. The ceiling-embedded air conditioner according to claim 4, wherein the air blower includes a fan motor, an impeller driven by the fan motor, and a fan casing surrounding the impeller, and a side of the fan casing that faces the front heat exchange part is formed in a horizontal plane.

15. The ceiling-embedded air conditioner according to claim 1, wherein a distance between an upper end of the front heat exchange part and an upper end of the rear heat exchange part is larger than a distance between a lower end of the front heat exchange part and a lower end of the rear heat exchange part.

16. The ceiling-embedded air conditioner according to claim 2, wherein a distance between an upper end of the front heat exchange part and an upper end of the rear heat exchange part is larger than a distance between a lower end of the front heat exchange part and a lower end of the rear heat exchange part.

17. The ceiling-embedded air conditioner according to claim 3, wherein a distance between an upper end of the front heat exchange part and an upper end of the rear heat exchange part is larger than a distance between a lower end of the front heat exchange part and a lower end of the rear heat exchange part.

18. The ceiling-embedded air conditioner according to claim 4, wherein a distance between an upper end of the front heat exchange part and an upper end of the rear heat exchange part is larger than a distance between a lower end of the front heat exchange part and a lower end of the rear heat exchange part.

19. The ceiling-embedded air conditioner according to claim 5, wherein a distance between an upper end of the front heat exchange part and an upper end of the rear heat exchange part is larger than a distance between a lower end of the front heat exchange part and a lower end of the rear heat exchange part.

* * * * *